US006907212B2

(12) United States Patent
Harada et al.

(10) Patent No.: US 6,907,212 B2
(45) Date of Patent: Jun. 14, 2005

(54) PHOTORECEPTOR DRUM AND IMAGE FORMING APPARATUS

(75) Inventors: Yoshikazu Harada, Nara (JP); Toshio Yamanaka, Yao (JP); Eiichi Kido, Yamatokoriyama (JP); Toshiaki Ino, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 43 days.

(21) Appl. No.: 10/144,930

(22) Filed: May 15, 2002

(65) Prior Publication Data

US 2002/0172531 A1 Nov. 21, 2002

(30) Foreign Application Priority Data

May 15, 2001 (JP) ..... 2001-145519

(51) Int. Cl.[7] ..... G03G 15/00
(52) U.S. Cl. ..... 399/167
(58) Field of Search ..... 399/167, 110

(56) References Cited

U.S. PATENT DOCUMENTS

| | | | | |
|---|---|---|---|---|
| 5,023,660 A | * | 6/1991 | Ebata et al. | 399/111 |
| 5,323,213 A | * | 6/1994 | Ahn | 399/75 |
| 5,495,327 A | * | 2/1996 | Inomata | 399/167 |
| 5,927,148 A | | 7/1999 | Yamanaka et al. | |
| 6,097,909 A | * | 8/2000 | Watanabe et al. | 399/111 |
| 6,161,446 A | | 12/2000 | Yamanaka et al. | |
| 6,188,857 B1 | | 2/2001 | Yamanaka et al. | |

FOREIGN PATENT DOCUMENTS

| | | | |
|---|---|---|---|
| JP | 58-120265 | | 7/1983 |
| JP | 64-021466 | | 1/1989 |
| JP | 3-28324 | U | 3/1991 |
| JP | 6-258884 | A | 9/1994 |
| JP | 8-44246 | A | 2/1996 |
| JP | 8-87225 | * | 4/1996 |
| JP | 10-153941 | A | 6/1998 |
| JP | 10-232526 | A | 9/1998 |
| JP | 63-289561 | A | 11/1998 |
| JP | 2000-214654 | A | 8/2000 |
| JP | 2000-352898 | A | 12/2000 |

* cited by examiner

*Primary Examiner*—Quana M. Grainger
(74) *Attorney, Agent, or Firm*—Birch, Stewart, Kolasch & Birch, LLP

(57) ABSTRACT

An image forming apparatus is provided with a photoreceptor drum which includes a cylindrical drum whose surface is coated with a photosensitive layer, and a rear-side drum flange section; and a developer. A coupling section at which the photoreceptor drum is attached to or detached from an image forming apparatus main body includes an input section and an apparatus output section. The input section is includes an internal gear having teeth of an involute curve formed in an inner surface of the rear-side flange section and receives rotation driving force from the image forming apparatus main body. The apparatus output section is composed of an external gear having teeth in the same shape and in the number as the internal gear, and outputs the rotation driving force from the image forming apparatus main body to the input section.

26 Claims, 10 Drawing Sheets

PHOTORECEPTOR DRUM AND IMAGE FORMING APPARATUS

FIELD OF THE INVENTION

The present invention relates to an image forming apparatus of an electro-photographic system such as a copying machine, a printer, a facsimile etc., and also relates to a photoreceptor drum adopted in such image forming apparatus.

BACKGROUND OF THE INVENTION

Conventionally, in a copying machine, a printer, a facsimile, or other image forming apparatus of the electrophotographic printing system, a toner image is formed by developing an electrostatic latent image formed on an image holding member (photoreceptor), and further transferring the toner image formed onto a sheet to be affixed thereto, thereby forming an image on a sheet. For this image holding member, generally adopted is a photoreceptor drum whose peripheral surface is coated with a photosensitive film.

By the way, in order to obtain a desirable image using the foregoing photoreceptor drum, it is required to exchange the photoreceptor drum periodically. In response, the photoreceptor drum is stored in an exchangeable unit structure to be detachable from an image forming apparatus main body with ease. The photoreceptor drum becomes rotatable upon receiving rotation-driving force from a rotation drive section of the image forming apparatus main body. As means for transmitting the rotation driving force from the image forming apparatus main body, for example, as disclosed in Japanese Patent Publication No. 64-21466/1989 (Tokukaisho 64-21466, published on Jan. 24, 1989), generally adopted is gear transmission means, or coupling means (relay means) wherein a recessed part and a protruded part respectively formed on a drive section and a driven section are in engagement.

On the other hand, in order to obtain a desirable image using the photoreceptor drum, it is necessary to apply uniform rotation driving forces to the photoreceptor drum. Here, generation of jerky movement of the driving force transmission means for transmitting the driving force to the photoreceptor drum would be the problem.

In order to prevent such jerky rotation movement, the gear transmission means of Japanese Patent Publication No. 64-21466/1989 is arranged so as to provide an internal gear with a taper provided at a flange having attached thereto a photoreceptor drum and an external gear provided with a taper on a side of a drive section. As a result, the jerky rotation movement to be transmitted from the driving force transmission means to the photoreceptor drum can be suppressed.

Japanese Patent No. 3078464 (U.S. Pat. No. 6,188,857; U.S. Pat. No. 6,161,446; and U.S. Pat. No. 5,927,148) discloses a photoreceptor unit provided with a flange with an internal gear. This photoreceptor unit is provided with a reinforcing member in the flange. This photoreceptor unit is provided with a reinforcing member at the flange. Further, this photoreceptor drum rotates upon receiving driving force at the internal gear of the flange via an external gear which serves as a drive gear. Here, the drive gear is smaller in size than the internal gear of the flange. With this structure, the required engagement precision of the internal gear can be maintained.

However, with the structure of the Japanese Unexamined Patent Publication No. 64-21466/1989, even if the drive section and the photoreceptor drum are manufactured with high precision, it would not be possible to completely eliminate eccentric error or axis deviation of gears in engagement, there is no win situation to eliminate such eccentricity or eccentric axis. In this state, when the photoreceptor drum and the drive section are connected without generating jerky movement, for example, due to the excessive force exerted to the connected part, a force is exerted in the direction of disturbing stable engagement of the gears, which hinders smooth rotation movement. Additionally, due to the taper provided at the connected part, a force is exerted in the direction of moving the photoreceptor drum in the axial direction, thereby presenting the problem that deviation of the photoreceptor drum in the axial direction is liable to occur periodically.

According to the structure of Japanese Patent No. 3078464, it is necessary for the driving gear on the side of the image forming apparatus main body. Therefore, a distance between the axes of the external gear and the internal gear is liable to change due to variations in load of the driving transmission, etc., thereby presenting the problem that stable rotation movement of the photoreceptor drum cannot be ensured.

SUMMARY OF THE INVENTION

It is an object of the present invention to provide a photoreceptor drum and an image forming apparatus which permit rotation driving force to be transmitted from the side of the driving section without the problem of jerky rotation movement, and which permit the rotation driving force to be transmitted to the unit which acts on the driving section without the problem of jerky rotation movement.

In order to achieve the above object, the photoreceptor drum, of the present invention be arranged so as to include:

A barrel-shaped drum (e.g., a cylindrical drum) provided in an image forming apparatus main body, having a photosensitive layer formed on a peripheral surface thereof; and a flange having an input section provided at the barrel-shaped drum, for receiving rotation driving force from the image forming apparatus main body, and an output section for transmitting the rotation driving force to the process unit which acts on the barrel-shaped drum, wherein the output section is composed of an external gear formed on a peripheral surface of the flange; and the input section is composed of an internal gear formed on an inner surface of the flange.

According to the foregoing structure, the input section which receives the rotation driving force from the image forming apparatus main body is composed of the internal gear formed on the inner surface of the flange, and thus for the apparatus output section for transmitting the rotation driving force to the input section in the image forming apparatus main body, for example, the external gear in engagement with the internal gear of the input section can be adopted. It is therefore possible to ensure smooth rotation movements of the photoreceptor drum. Namely, the rotation driving force can be transmitted from the image forming apparatus main body to the photoreceptor drum at constant angular velocity.

Further, by transmitting the rotation driving force to the process unit by the output section composed of the external gear, smooth rotation movement of the processing unit can be ensured. Namely, from the photoreceptor drum to the process unit, the rotation driving force can be transmitted at a constant angular velocity.

It is preferable that the photoreceptor drum be detachably provided in the image forming apparatus main body.

It is also preferable that the internal gear be formed so as to have a positive addendum modification amount.

According to the foregoing structure, by adopting the internal gear having a positive addendum modification amount, the engagement between the image forming apparatus main body (apparatus output section) and the photoreceptor drum can be achieved by adopting the external gear. Furthermore, a backlash can be formed between the external gear of the apparatus output section and the internal gear of the input section. Therefore, even if axis deviation or eccentricity occurs between the center of rotations of the internal gear and the center of rotations of the internal gear, that can be absorbed by the backlash. As a result, stable rotation movement of the photoreceptor drum can be achieved.

Furthermore, in the case of adopting the external gear for the apparatus output section, which has the same number of teeth as the internal gear of the input section, as the internal gear has a positive addendum modification amount, even if the external gear of the apparatus does not have a negative addendum modification, the photoreceptor drum can be installed in the image forming apparatus main body with ease. As a result, it is not necessarily to form the member which constitutes the apparatus output section of the image forming apparatus main body to be smaller than the standard size. As a result, a sufficient strength of the apparatus output section of the image forming apparatus main body can be ensured.

It is further preferable that the internal gear be shaped to have an involute curve.

According to the foregoing structure, even if axis deviation or eccentricity occurs between the center of rotations of the internal gear and the center of rotations of the internal gear, rotations of the apparatus output section of the image forming apparatus main body can be surely transmitted to the photoreceptor drum with accuracy.

It is also preferable that the photoreceptor drum be arranged such that the output section and the input section are formed in the same cross-section orthogonal to a rotation axis of the photoreceptor drum.

According to the foregoing structure, forces in response to the input and output with respect to the flange are generated in the same cross section orthogonal to the rotation axis of the photoreceptor drum. As a result, smooth rotation movements of the photoreceptor drum can be ensured without generating the force picking the flange. Furthermore, the rotation driving force, which ensures the smooth rotation movements, can be applied from the flange to the rotation member of the process unit.

Another photoreceptor drum of the present invention is arranged so as to include:

a barrel-shaped drum detachably provided in an image forming apparatus main body, having a photosensitive layer formed on a peripheral surface thereof; and a flange having an input section provided at one end of the barrel-shaped drum, for receiving rotation driving force from the image forming apparatus main body, and an output section for transmitting the rotation driving force to the process unit which acts on the barrel-shaped drum, wherein the output section is composed of an external gear formed on a peripheral surface of the flange; and the input section is composed of an internal gear formed on an inner surface of the flange, and the output section and the input section are formed in the same cross-section orthogonal to a rotation axis of the photoreceptor drum.

According to the foregoing structure, the input section which receives the rotation driving force from the image forming apparatus main body is composed of the internal gear formed on the inner surface of the flange, and thus for the apparatus output section for transmitting the rotation driving force to the input section in the image forming apparatus main body, for example, the external gear in engagement with the internal gear of the input section can be adopted. It is therefore possible to ensure smooth rotation movements of the photoreceptor drum. Further, by transmitting the rotation driving force to the processing unit by the output section composed of the external gear formed on the peripheral surface of the flange, smooth rotation movements of the processing unit can be ensured.

Furthermore, it is preferable that the photoreceptor drum be arranged such that the output section and the input section are formed in the same cross-section orthogonal to a rotation axis of the photoreceptor drum. Therefore, forces in response to the input and output with respect to the flange are generated in the same cross section orthogonal to the rotation axis of the photoreceptor drum. As a result, smooth rotation movements of the photoreceptor drum can be ensured without generating the force picking the flange. Furthermore, the rotation driving force which ensures the smooth rotation movements can be applied from the flange to the rotation member of the process unit.

According to the foregoing structure, the rotation driving forces transmitted to the photoreceptor drum from the apparatus output section of the image forming apparatus main body can be further transmitted to the process unit with accuracy. Namely, as long as the apparatus output section of the image forming at constant angular velocity, the photoreceptor drum can be rotated at constant angular velocity, thereby ensuring smooth rotation movements. Further, the smooth rotation movement of the process unit at constant angular velocity apparatus main body can be ensured.

The image forming apparatus of the present invention is arranged so as to include:

a photoreceptor drum and a process unit which acts on the photoreceptor drum which are detachably provided;

the photoreceptor drum including a barrel-shaped drum whose peripheral surface is coated with a photosensitive layer and which is provided with a flange;

a coupling section at which the photoreceptor drum is attached to or detached from the image forming apparatus includes an input section and an apparatus output section;

the input section is composed of an internal gear formed on the inner surface, and receives rotation driving force from the image forming apparatus main body; and the apparatus output section includes an external gear having teeth in the same number as the internal teeth, provided in an image forming apparatus main body for outputting rotation driving force from the image forming apparatus main body to the input section.

According to the foregoing structure, the input section composed of an internal gear in the flange of the photoreceptor drum and the apparatus output section composed of the external gear in the image forming apparatus main body function as the coupling between the photoreceptor drum and the image forming apparatus main body. Furthermore, the internal gear of the input section and the eternal gear of the apparatus output section have teeth in the same number. Therefore, a stable coupling can be achieved, and it is therefore possible to realize the image forming apparatus main body, which permits smooth rotation movements of the photoreceptor drum. Namely, it is possible to transmit the rotation driving force from the image forming apparatus main body to the photoreceptor drum to rotate the photoreceptor drum at constant angular velocity.

With the foregoing structure, by adopting the same number of teeth for the external gear and the internal gear, it is possible to transmit the rotation driving force using all the teeth (whole circumference). Therefore, with respect to the driving axis which rotates the external gear of the apparatus output section, the external gear receives uniform force from the apparatus output section, and the tilt of the driving axis is less likely to occur, and rotation driving forces can therefore be transmitted with accuracy for a long period of time.

With the conventional coupling, it is not possible to measure the shape of the output section. Here, the measuring method for gears is standardized by JGMA or JIS. Therefore, with such standardized method, it is possible to measure the shape of the external gear serving as an output section. As a result, it is possible to manage the shape precision of the output section with ease.

It is preferable that the image forming apparatus be arranged such that the flange includes an output section for transmitting rotation driving force to the process unit; and the output section and the input section are formed on the same cross-section orthogonal to the rotation axis of the photoreceptor drum.

According to the foregoing structure, forces in response to the input and output with respect to the flange are generated in the same cross section orthogonal to the rotation axis of the photoreceptor drum. As a result, smooth rotation movements of the photoreceptor drum can be ensured without generating the force picking the flange. Furthermore, the rotation driving force, which ensures the smooth rotation movements can be applied from the flange to the rotation member of the process unit. As a result, an image forming apparatus, which permits stable rotation movements of the photoreceptor drum and the process unit can be achieved.

It is preferable that a backlash be provided between the internal gear of the input section and the external section of the apparatus output section.

According to the foregoing structure, the gear which functions as the coupling when installing the photoreceptor drum unit can be made in smooth engagement with the internal gear.

It is also preferable that the internal gear be formed so as to have a positive addendum modification amount.

According to the foregoing structure, the internal gear has a positive addendum modification amount, and thus even if the external gear of the apparatus does not have a negative addendum modification, the photoreceptor drum can be installed in the image forming apparatus main body with ease. As a result, it is not necessarily to form the member, which constitutes the apparatus output section of the image forming apparatus main body, to be smaller than the standard size. As a result, a sufficient strength of the apparatus output section of the image forming apparatus main body can be ensured.

It is preferable that the internal gear has teeth in a number of not less than 14.

By adopting the internal gear having teeth in a number of not less than 14, the undercutting of teeth can be prevented in the process of cutting the teeth. As a result, a reliable image forming apparatus can be achieved.

It is preferable that the process unit is a developer unit having a developer roller, which is pressed onto the photoreceptor drum to supply developer to the photoreceptor drum.

According to the foregoing structure, even if the developer roller, which acts on the photoreceptor drum is pressed onto the photoreceptor drum, smooth rotation movements of the developer roller can be achieved with respect to the photoreceptor drum without generating forces which disturb the smooth rotation movements of the photoreceptor drum and the developer roller. As a result, an image without banding (uneven dark and light coloring of images occurred periodically) can be obtained.

It is also preferable to satisfy the condition of:

$$0<X-Xs\leqq 0.15,$$

wherein X is an addendum modification coefficient of the internal gear of the input section and Xs is an addendum modification of the external gear.

According to the foregoing structure, an appropriate backlash can be formed between the internal gear of the input section which functions as a coupling and the external gear of the apparatus output section. Therefore, even if eccentricity error of the external gear of the apparatus output section or the axis deviation between the rotation axis of the photoreceptor drum and the rotation axis of the external gear of the apparatus output section occur, the internal gear of the input section and the external gear of the apparatus output section can be made in smooth engagement, thereby smoothly transmitting rotation driving forces at constant angular velocity. Furthermore, the photoreceptor drum unit can be installed in the image forming apparatus main body with ease.

It is preferable that the internal gear and the external gear have teeth shaped to have an involute curve.

Another image forming apparatus of the present invention is arranged so as to include:

a photoreceptor drum unit provided with a photoreceptor drum including a barrel-shaped drum whose peripheral surface is coated with a photosensitive layer, the photoreceptor drum unit being detachably provided from an image forming apparatus main body, wherein:

the barrel-shaped drum includes a first flange at one end, a second flange at the other end and a rotation axis which passes through a center of the barrel-shaped drum and which supports the first flange and the second flange;

the first flange includes an input section for receiving rotation driving force from the image forming apparatus main body and an output section for transmitting rotation driving force to the process unit which acts on the photoreceptor drum;

one end of the rotation axis is projected out of the second flange and is supported by the flame member of the photoreceptor drum unit so as to be freely rotatable;

the other end of the rotation axis extends to a position where the input section and the output section are overlapped with each other; and at the position where the input section and the output section are overlapped, the other end of the rotation axis is fit in a fitting section provided in an axis of the image forming apparatus main body for transmitting rotation driving force to the barrel-shaped drum.

According to the foregoing structure, the fitting section which supports the rotation axis of the photoreceptor drum and the input section which inputs rotation driving force from the image forming apparatus to the photoreceptor drum, and the section which outputs the rotation driving force to the process unit which acts on the photoreceptor drum can be positioned on the same cross section orthogonal to the rotation axis of the photoreceptor drum. As a result, rotation driving force can be applied and output in and from the photoreceptor drum smoothly, and thus such force which causes axis deviation between the rotation axis and the driving axis of the photoreceptor drum can be eliminated.

Furthermore, the rotation axis of the photoreceptor drum is directly fit in the driving axis without via an intermediate member, deviation of the rotation axis and the driving axis of the photoreceptor drum is not generated. As a result, the photoreceptor drum can be fit in the image forming apparatus main body with high precision.

It is preferable that in a state where the photoreceptor drum unit is mounted to an image forming apparatus main body, the flame member of the photoreceptor drum unit is supported by the support member which supports the axis of the image forming apparatus main body.

According to the foregoing structure, when mounting the photoreceptor drum unit to the image forming apparatus main body, the photoreceptor drum is supported by the axis of the image forming apparatus main body, and the flame of the photoreceptor drum unit is supported by the support member which supports the axis of the image forming apparatus main body. As a result, a contact between the photoreceptor drum and the flame of the photoreceptor drum unit can be completely avoided.

As a result, the photoreceptor drum can be prevented from being too tightly engaged both on the image forming apparatus main body side and the photoreceptor drum unit side, and thus smooth rotation movement of the photoreceptor drum can be ensured with high precision.

For a fuller understanding of the nature and advantages of the invention, reference should be made to the ensuing detailed description taken in conjunction with the accompanying drawings.

BRIEF DESCRIPTION OF THE DRAWINGS

FIG. 2(*b*) is an explanatory view illustrating the structure of essential parts of a photoreceptor drum unit in accordance with the image forming apparatus of FIG. 1.

FIG. 2(*c*) is an explanatory view illustrating the structure of a developer of the image forming apparatus of FIG. 1.

DESCRIPTION OF THE EMBODIMENTS

[Embodiment 1]

Referring to FIGS. 1 through 10, the following description will explain one embodiment of the present invention.

Figure 3:
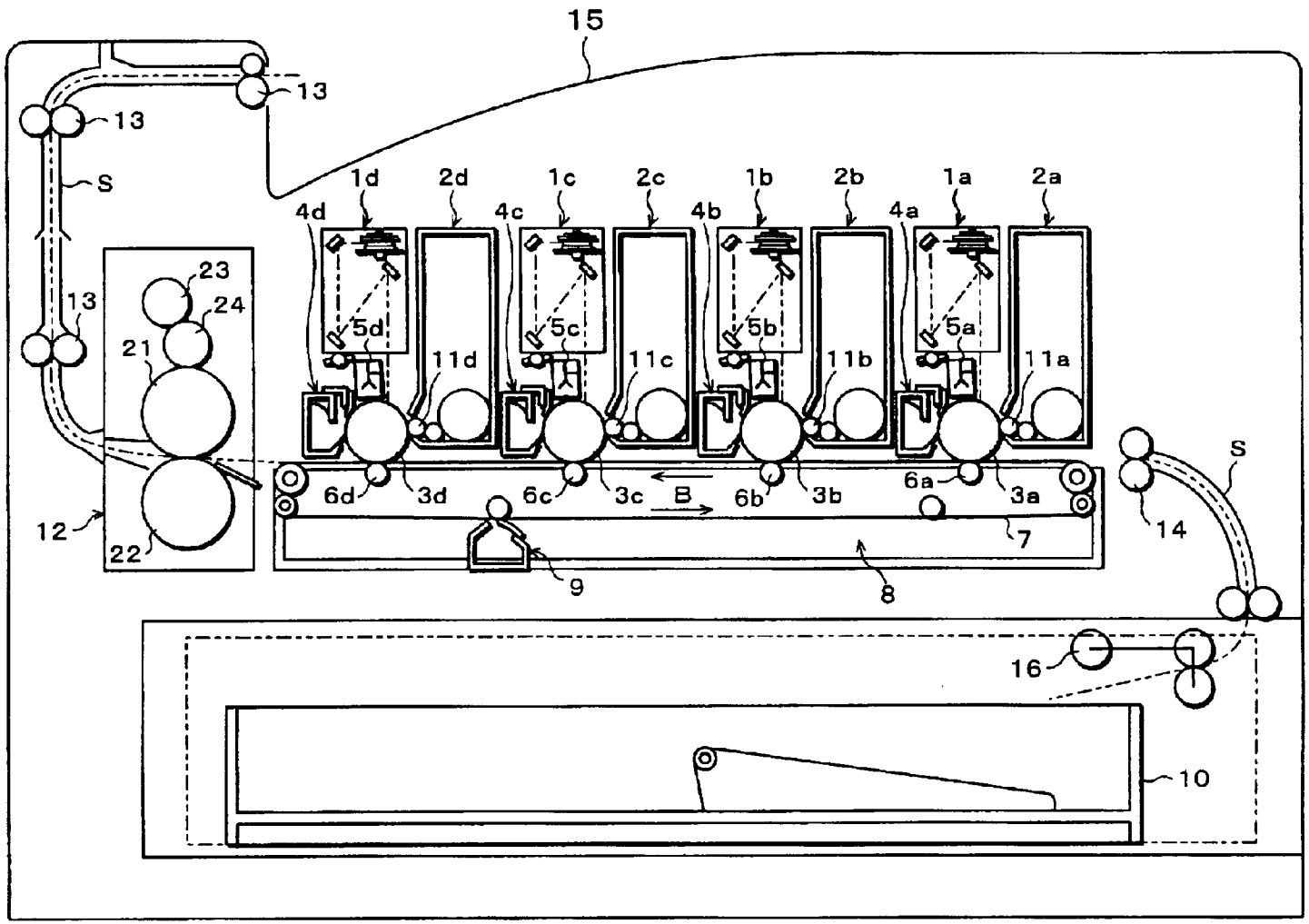
FIG. 3 is an explanatory view illustrating the structure of essential parts of a printer as an image forming apparatus in accordance with one embodiment of the present invention.

FIG. 3 is an explanatory view illustrating the structure of a printer as an image forming apparatus in accordance with the present embodiment. This printer is arranged so as to form a color image on a predetermined sheet (recording sheet) based on image data as transmitted from an external section. As illustrated in FIG. 3, the printer of the present embodiment includes optical units 1*a*, 1*b*, 1*c* and 1*d*, developer units (process units) 2*a*, 2*b*, 2*c* and 2*d*, photoreceptor drums 3*a*, 3*b*, 3*c* and 3*d*, cleaning units 4a, 4*b*, 4*c* and 4*d* and chargers 5*a*, 5*b*, 5*c* and 5*d*, a transport belt unit 8, a fixing unit 12, a sheet transport path S, a feed tray 10, and a discharge tray 15.

The image data to be processed in the printer of the present embodiments correspond to color image in respective colors, i.e., black (K), cyan (C), magenta (M), and yellow (Y). Therefore, the image forming stations are provided with optical units 1a to 1d, developer units 2*a* to 2*d*, photoreceptor drums 3*a* to 3*d*, cleaning units 4*a* to 4*d* and chargers 5*a* to 5*d*, in number of four for each member for respective four colors. Here, the optical unit 1*a*, the developer unit 2*a*, the photoreceptor drum 3*a*, the cleaning unit 4*a* and the charger 5*a* are provided for black color; the optical unit 1*b*, the developer unit 2*b*, the photoreceptor drum 3*b*, the cleaning unit 4*b*and the charger 5*b* are provided for cyan color; the optical unit 1*c*, the developer unit 2*c*, the photoreceptor drum 3*c*, the cleaning unit 4*c*and the charger 5*c* are provided for magenta color; and the optical unit 1*d*, the developer unit 2*d*, the photoreceptor drum 3*d*, the cleaning unit 4*d* and the charger 5*d* are provided for yellow color.

The photoreceptor drums 3*a* to 3*d* are provided so as to be in contact with the periphery of the transfer belt 7 (to be described later) at around substantially the center of the printer of the present embodiment. Further, around the outer circumference of each of the photoreceptors 3*a* to 3*d*, provided for respective colors are the charger (5*a* to 5*d*), the photoreceptor unit (1*a* to 1*d*), developer units (2*a* to 2*d*), and the cleaner units (4*a* to 4*d*).

Each of the chargers 5*a* to 5*d* is provided for uniformly charging the surface of the corresponding photoreceptor drum (3*a* to 3*d*) to a predetermined potential.

Each of the optical units 1*a* to 1*d* is provided with a laser emitting section and a reflective mirror, and serves as a laserscanning unit (LSU) of the printer of the present embodiment. This laser units 1*a* to 1*d* are provided with a function of forming an electrostatic latent image corresponding to image data on the surface thereof as charged by projecting thereto a laser beam.

The developer units (2*a* to 2*d*) are provided for visualizing an electrostatic latent image formed on the corresponding photoreceptor drums (3*a* to 3*d*) with toner (K, C, M, Y). Each developer unit (2*a* to 2*d*) includes a developing roller (11*a*, 11*b*, 11*c* and lid), which is brought in tight contact with each of the photoreceptor drums 3*a* to 3*d* to apply thereto toner. These developing rollers 11*a* to 11*d* also correspond to respective colors K, C, M and Y. The cleaning units 4*a* to 4*d* are provided for removing and collecting toner remaining on the surface of the photoreceptor drums 3*a* to 3*d* after developing/transferring image.

The transfer transport belt unit 8 provided under the photoreceptor drums 3*a* to 3*d* includes a transfer belt 7, a transfer belt driving roller, a transfer belt tension roller, a plurality of transfer belt driven rollers, transfer rollers 6*a*, 6*b*, 6*c* and 6*d*, and a transfer belt cleaning unit 9.

The transfer belt driving roller, the transfer belt driven rollers and the transfer belt tension roller are provided for stretching out the transfer belt 7 to be belted as desired, and rotating the transfer belt 7 as set in the direction of an arrow B.

The axis of each of the transfer rollers 6*a* to 6*d* is supported by the frame (not shown) within the intermediate transfer belt unit so as to be rotabable. These transfer rollers 6*a* to 6*d* also stretch out the transfer belt 7 to be belted properly together with the aforementioned transfer belt driving roller, the transfer belt driven rollers and the transfer belt tension roller. Further, each of the transfer rollers 6*a* to 6*d* is provided for transferring the toner image on the photoreceptor drum (3*a* to 3*d*) onto a sheet which is conveyed as being attracted onto the transfer belt 7.

This transfer belt 7 is provided so as to be in contact with each photoreceptor drum (3*a* to 3*d*). This transfer belt 7 is provided for forming a toner image (multicolor toner images) by sequentially transferring the toner images in respective colors formed on the corresponding photoreceptor drums 3*a* to 3*d*. This transfer belt 7 is an endless belt made of a film in around 100 $\mu$m in thickness.

The foregoing transfer of the toner image formed on each of the photoreceptor drums 3*a* to 3*d* is carried out using the transfer rollers 6*a* to 6*d* in contact with the back side of the transfer belt 7. To these transfer rollers 6*a* to 6*d*, applied are high voltage in reverse polarity (+) to the charged polarity (−) of the toner to transfer the toner images. Each of these transfer rollers 6*a* to 6*d* has a metal axis made of, for example, stainless, as a base in 8 to 10 mm diameter. The surface of each transfer roller 6*a* to 6*d* is covered with an electrically conductive elastic member made of, for example, EPDM (ethylene propylen dine monomer), foamed urethane, etc. With this electrically conductive elastic member, it is possible to apply a high voltage uniformly onto a sheet.

Further, the toner adhering onto the transfer belt as being transferred from the corresponding photoreceptor drum 3*a* to 3*d* may cause a contamination of the back surface a recording material.

A feed tray 10 is provided for storing sheets for printing. This sheet tray 10 is provided under the image forming section of the printer of the present embodiment. On the other hand, a discharge tray 15 above the printer of the present embodiment is provided for storing sheets after printing.

The printer of the present embodiment is further provided with a S-shaped sheet transport path S for transporting the sheet in the feed tray 10 onto the discharge tray 15 via the transfer belt unit 8 and the fixing unit 12. In a vicinity of these trays 10 and 15, and the sheet transport path S, provided are a pickup roller 16, a resist roller 14, a fixing unit 12, and the transport rollers 13.

These transport rollers 13 are small rollers provided for facilitating and aiding the transportation of the sheets along the sheet transport path S. The pickup roller 16 is provided at the end of the sheet tray 10. This pickup roller 16 is provided for feeding in sheets from the feed tray 10 one by one onto the sheet transport path S.

The resist roller 14 is provided for temporarily storing the sheet being transported along the sheet transport path S. This resist roller 14 then transports a sheet at an appropriate timing according to the rotations of the photoreceptor drums 3*a* to 3*d* to enable the multiplex transfer of toner images formed on the photoreceptor drums 3*a* to 3*d* onto a sheet at appropriate positions as achieved by positioning. Namely, the resist roller 14 is set so as to transfer sheets so that the leading end of each of the toner images formed on the photoreceptor drums 3*a* to 3*d* is set at the leading end of the print range of the sheet.

The fixing unit 12 includes a heat roller 21, a pressure roller 22, and releasing agent application rollers 23, 24. These heat roller 21 and the pressure roller 22 rotate so as to sandwitch the sheet. The heat roller 21 is set at a predetermined fixing temperature by a control section (not shown) based on an output value of the temperature detector (not shown). Together with the pressure roller 22, the heat roller 21 performs a thermo-compression bonding with respect to a sheet so as to melt, mix and weld with pressure a multicolor toner image as transferred onto the sheet, thereby thermo-compressing the multicolor toner image formed on the sheet.

The sheet as fed in the sheet transport path S from the feed tray 10 is further transported to the resist roller 14 along the sheet transport path S. The sheet is then fed onto the transfer belt 7 at an appropriate timing. The sheet is transported to the fixing unit 12 onto the transfer belt 7 in the direction of B. While the sheet is being transported, the toner images formed on the photoreceptor drums 3*a* to 3*d* respectively are transferred onto the sheet by the photoreceptor drums 3*a* to 3*d* and the transfer rollers 6*a* to 6*d*. After fixing the multicolor toner image, the sheet is transported to the reverse discharge path of the sheet transport path S by the transfer rollers 13 (with the multicolor toner image facedown) onto the discharge tray 15. The sheet is then discharged onto the discharge tray 15.

Here, explanations have been given through the case of adopting a color printer as an image forming apparatus; however, an image forming apparatus provided with a single image forming station may be adopted as well.

In the following, the structures of the photoreceptor drum 3, and sections around the photoreceptor drum 3 will be explained based on FIG. 1, FIG. 2, FIG. 4 and FIG. 10.

Figure 2:
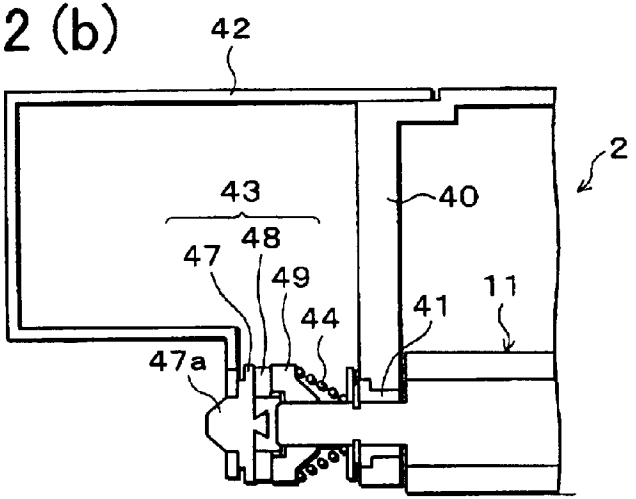
FIG. 2(*a*) is an explanatory view illustrating the structure of a main body of the image forming apparatus of FIG. 1.
Figure 2:
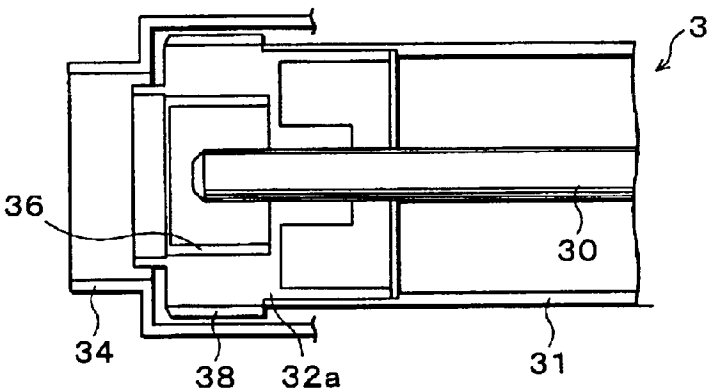
Figure 2:
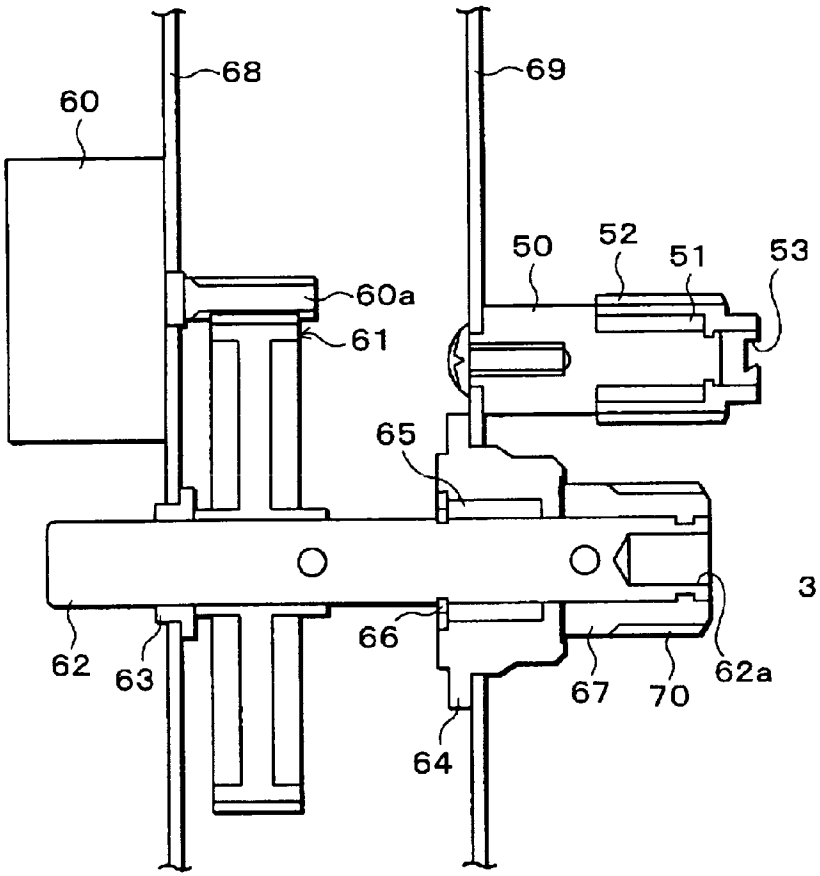

FIG. 2(*a*) is an explanatory view illustrating the structure of the image forming apparatus main body. FIG. 2(*b*) is an explanatory view illustrating the structure of essential parts of the photoreceptor drum unit provided with the photoreceptor drum 3. FIG. 2(*c*) is an explanatory view illustrating the structure of the developer unit 2 (process unit).

Figure 1:
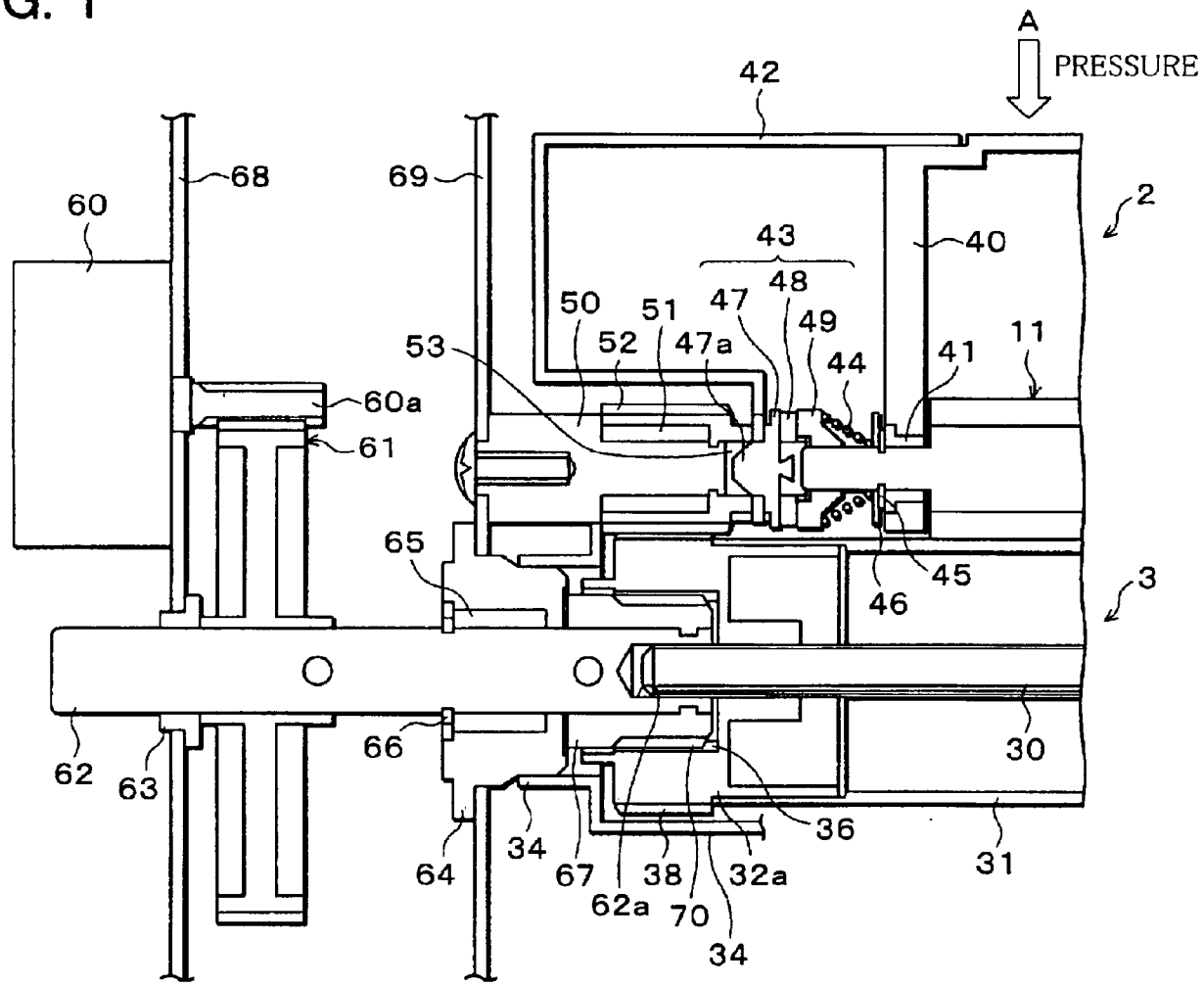
FIG. 1 is a cross-sectional view illustrating the structure of essential parts of an image forming apparatus in accordance with one embodiment of the present invention, in the state where a photoreceptor drum and a developing roller are mounted.

As illustrated in FIG. 1, the image forming apparatus main body of FIG. 2(*a*) is provided with a developing unit 2 provided with a developing roller 11 shown in FIG. 2(*b*), and the photoreceptor drum 3 shown in FIG. 2(*c*).

Figure 4:
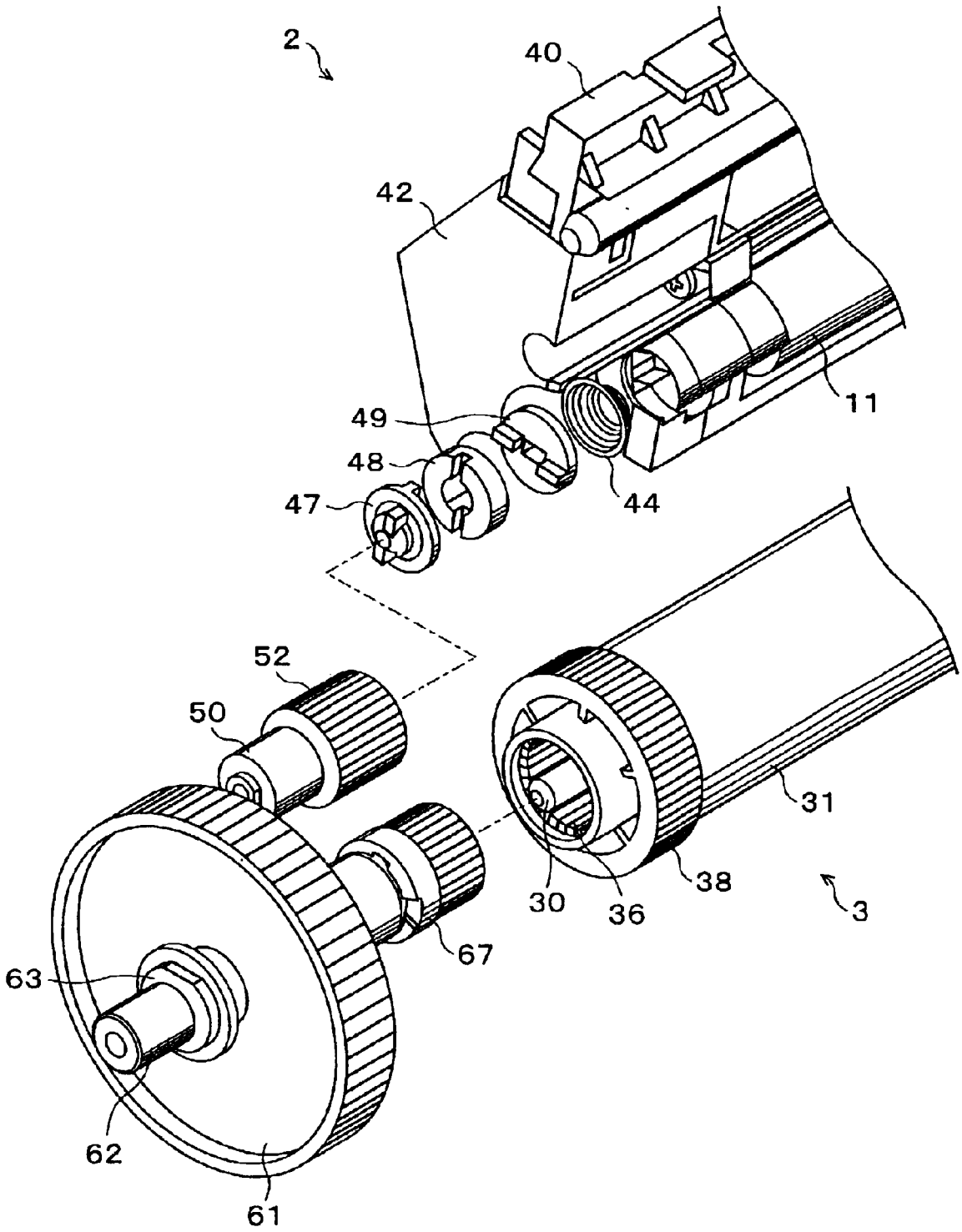
FIG. 4 is an explanatory view illustrating a detachable structure of the image forming apparatus of FIG. 1.

As illustrated in FIG. 4, the photoreceptor drum 3 and the developing unit 2 are mounted so as to be engagement with the gear 67 and the gear 52 respectively in the image forming apparatus main body.

Firstly, the structure of the photoreceptor drum 3 will be explained in reference to FIG. 5.

Figure 5:
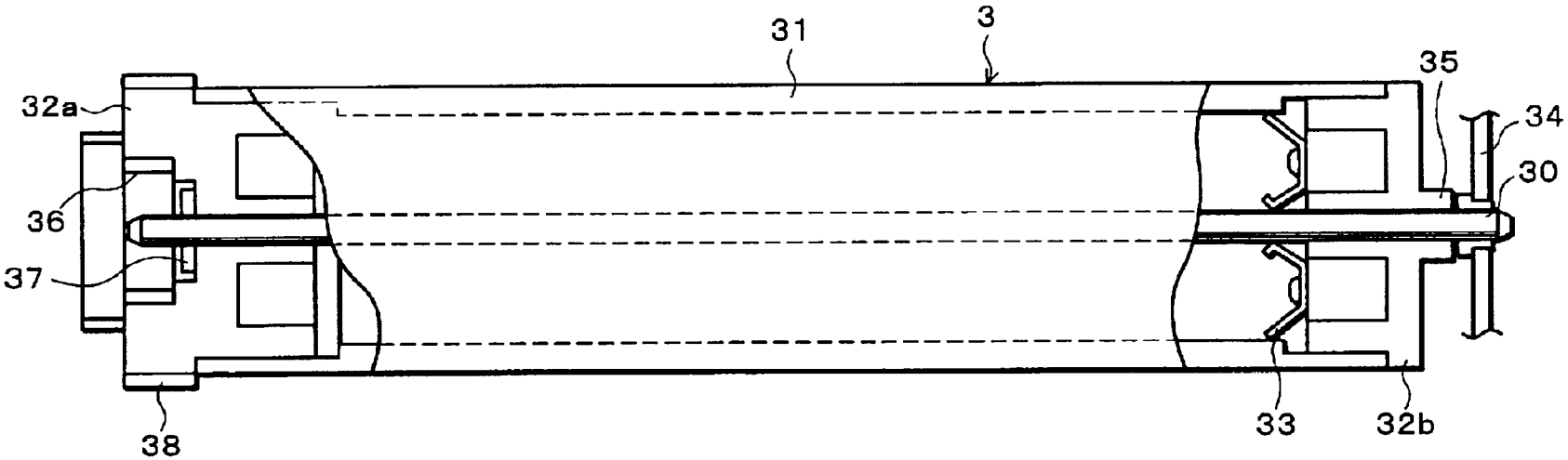
FIG. 5 is a cross-sectional view illustrating the structure of essential parts of a photoreceptor drum.
Figure 6:
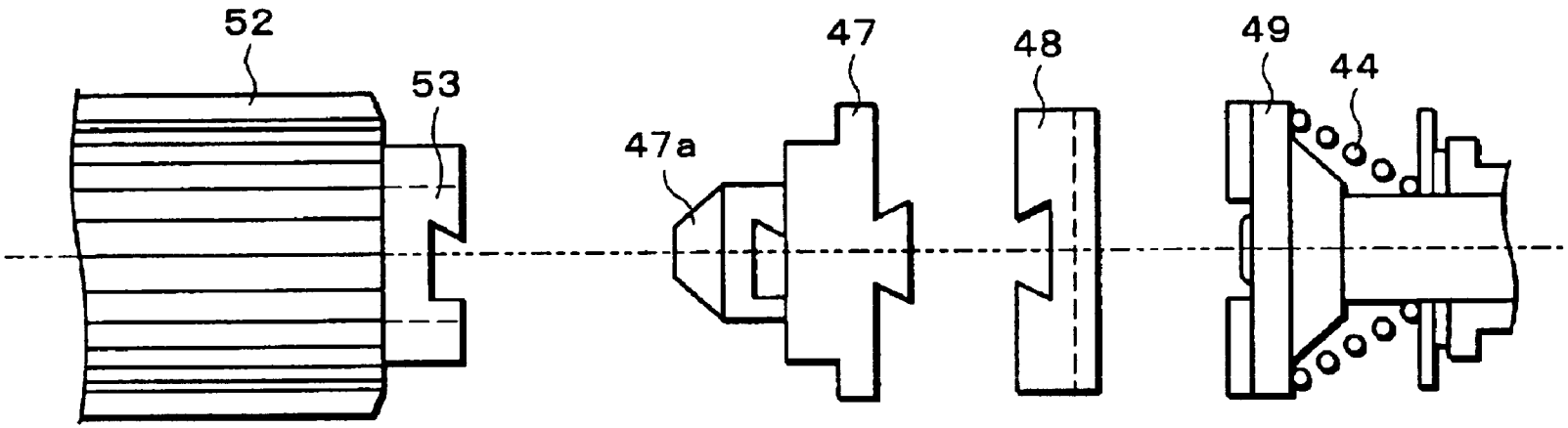
FIG. 6 is an explanatory view illustrating the coupling structure.

As illustrated in FIG. 5, the photoreceptor drum 3 includes a barrel-shaped drum (photoreceptor drum main body) 31, a front-side drum flange section 32*b*, a rear-side drum flange section 32*a*, and an earth member 33. These front-side drum flange section 32*b* and the rear-side drum flange section 32*a* are mounted so as to be fit in the respective ends of the barrel-shaped drum 31. Further, a drum axis 30 (rotation axis) as supported by a bearing 35 mounted to a photoreceptor drum unit frame 34 is inserted so as to go through central parts of the front-side drum flange section 32*b* and the rear-side drum flange section 32*a*. For this drum axis 30, adopted is an iron-series metal shaft with a diameter of around 6 mm. To this drum axis 30, mounted is a pin 37 provided for preventing the bearing 35 from falling off on the outside of the rear-side drum flange section 32*a* (flange, first flange).

The earth member 33 is mounted to the front-side drum flange section 32*b* (second flange) so as to be in contact with the inner circumference of the barrel-shaped drum 31 and the drum axis 30, and connect the metal barrel-shaped drum 31 via the drum axis 30.

The photoreceptor drum unit frame 34 (frame member) is a cabinet of the photoreceptor drum unit for storing the photoreceptor drum 3. When the photoreceptor drum 3 is taken out of the image forming apparatus main body for replacement, etc., the whole photoreceptor drum unit frame 34 is taken out.

To the rear-side drum flange section 32*a*, mounted are an internal gear 36 (input section, coupling section) and an external gear (output section) 38 provided around the drum shaft 30. This internal gear 36 serves as an input section for receiving the rotation driving force from the image forming apparatus main body. On the other hand, the external gear 38 serves as an output section for transmitting the rotation driving force to the developing roller 11 which acts on the barrel-shaped drum 31.

From the rear-side drum flange section 32*a*, a part of the leading end of the drum shaft 30 is projected.

Next, the driving section for driving the photoreceptor drum 3 will be explained.

As illustrated in FIG. 1 and FIG. 2(*a*), the driving section provided in the image forming apparatus main body for driving the photoreceptor drum 3 includes a drive motor 60, a gear 61, a drive shaft 62 (shaft), a bearing 63, a housing 64 (support member), a bearing 65, a cover ring 66, and a gear 67 (external gear, unit output section).

The drive motor 60 is mounted to the drive frame 68 of the image forming apparatus main body. This drive motor 60 includes a motor shaft 60*a* provided with a gear in engagement with the gear 61.

This gear 61 is mounted to the drive shaft 62 and transmits the rotation driving force as received from the drive motor 60 to the drive shaft 62. The drive shaft 62 is supported on the side of the image forming apparatus main body by the bearing 63 mounted to the drive frame 68, and the bearing 65 of the housing 64 mounted to the main frame 69 of the image forming apparatus main body. For the drive shaft 62, adopted is a shaft having an outer diameter of around 10 mm made of an iron-series metal shaft. Further, a cover ring 66 is mounted to the drive shaft 62 on the side of the gear 61 with respect to the housing 64. This cover ring 66 receives forces exerted onto the drive shaft 62 in the axial direction.

To the drive shaft 62, mounted is the gear 67 with teeth 70 on the side of the photoreceptor drum 3 on the opposite side of the cover ring 66 with respect to the housing 64. This gear 67 serves as the external gear which has teeth in the same number as the teeth of the internal gear 36 so that the gear 67 can be in engagement with the internal gear 36.

Using the external gear 67 and the internal gear 36, the drive gear 62 and the photoreceptor drum 3 are connected so as to be detachable, so that the rotation driving force from the drive motor 60 can be transmitted to the photoreceptor drum 3. Namely, the external gear 67 and the internal gear 36 function as a coupling between the drive shaft 62 and the photoreceptor drum 3. The detailed explanations of the external gear 67 and the internal gear 36 will be given later.

With the conventional coupling, it is not possible to measure the shape of the output section which outputs the rotation driving force from the image forming apparatus main body to the photoreceptor drum.

Hear, the measuring method for gears is standardized by JGMA or JIS. Therefore, with such standardized method, it is possible to measure the shape of the external gear 67 serving as an output section. Therefore, by adopting such precision classes, it becomes possible to measure the shape precision of the external gear 67 which serves as a unit output section. As a result, it is possible to manage the shape precision of the output section with ease.

Further, at around the end face of the driving shaft 62 on te side of the gear 67, formed is a hole 62*a* (fitting section) extending in an axial direction. To this hole 62*a*, the leading end of the drum shaft 30 is to be inserted. As a result, the respective positions as well as axial directions of the driving shaft 62 and the drum shaft 30 can be in agreement.

As described, the drum shaft 30, i.e., the rotation axis of the photoreceptor drum 3 is directly fitted in the driving shaft 62 without using an intermediate member. It is therefore possible to eliminate a deviation between the drum shaft 30 and the driving shaft 62. As a result, the photoreceptor drum 3 can be fitted to the image forming apparatus main body with high precision. Here, one end of the drum shaft 30, i.e., a part of the leading end of the drum shaft 30 projected from the rear-side drum flange section 22*a* is supported by the driving shaft 62, but is not supported by the photoreceptor drum unit frame 34. On the other hand, one end of the drum shaft 30 projected from the front side drum flange section 32*b* is supported by the bearing 35 of the photoreceptor drum unit frame 34.

With this structure, when the photoreceptor drum unit including the photoreceptor drum 3 is mounted to the image forming apparatus main body, the photoreceptor drum 3 is supported by the driving shaft 62 of the image forming apparatus main body, and the photoreceptor drum frame 34 is supported by the housing 64 which supports the drive shaft 62. Namely, the photoreceptor drum unit frame 34 is supported by the image forming apparatus main body by the housing 64. As a result, the photoreceptor drum 3 and the photoreceptor drum unit frame 34 can be maintained completely in non-contact state.

As a result, the drum shaft 30 can be prevented from being too tightly fixed to the image forming apparatus main body and the photoreceptor drum unit. As a result, the drum shaft 30 can rotate smoothly, whereby smooth rotation movements of the photoreceptor drum 3 can be ensured with high precision.

The developer unit 2 is provided in contact with the photoreceptor drum 3. The developer roller 11 of the developer unit 2 is pressurized onto the periphery of the drum barrel-shaped drum 31 with a predetermined contact force in a direction of an arrow A of FIG. 1. This pressure welding force is applied to an elastic member such as spring as suspended onto the developer unit 2. The developer unit 2 is displaced in a rotation direction by the elastic member about a predetermined position as a fulcrum. This welding pressure force is typically set within a range of from 700 to 2,000 g, typically 1,000 g.

The developer roller 11 and the barrel-shaped drum 31 are provided so that respective rotation axes are placed in parallel. The developer roller 11 is a rubber roller with an outer diameter of around 16 mm provided with an elastic rubber layer formed around the circumference of the core, and with the surface of this rubber roller, the developer (toner) is supplied onto the surface of the barrel-shaped drum 31, whereby an elastic latent image is formed on the surface of the barrel-shaped drum 31.

The developer roller 11 is mounted to a developer unit case 40 of a developer unit (processing unit), which constitutes the developer unit 2. Further, a stopper ring 45 and a plain washer 46 are mounted to the bearing 41 on the opposite side of the developer roller 11. The developer roller 11 is detachable from the image forming apparatus main body. Specifically, the developer roller 11 is take out of the apparatus by detaching therefrom the developer unit case 40 which stores therein the developer unit case 40. The developer unit and the photoreceptor drum unit are provided as two separate members so that they can be taken out independently.

According to the foregoing structure, the developer unit and the photoreceptor drum unit are supported independently. Therefore, when the developer roller 11 which acts on the photoreceptor drum 3 is pressed onto the photoreceptor drum 3, the force will not be exerted in the direction of disturbing mutual smooth rotation movements of the photoreceptor drum 3 and the developer roller 11, thereby ensuring smooth rotation movements of the developer roller 11 with respect to the photoreceptor drum 3. As a result, desirable images can be obtained by preventing blocky dark and light coloring which occurs at regular intervals.

The rotation driving force for droving the developer roller 11 is transmitted from the photoreceptor drum 3. More specifically, the developer roller 11 is in engagement with an external gear 38 formed in a flange section 32*a* on the rear-side of the photoreceptor drum 3, and thus the gear 52, which rotates by the rotations of the photoreceptor drum 3 is mounted to the image forming apparatus main body. The rotations of the gear 52 are transmitted to the developer roller 11 via the coupling 43. The gear 52 is mounted to the bearing 51 with respect to the support shaft 50 fixed to the main frame 69 of the image forming apparatus main body.

The coupling 43 is provided on the side of the developer unit 2, for absorbing deviation of the rotation center axis of the gear 52 and the rotation center axis of the developer roller 11 . For this coupling 43, an Oldham's coupling is typically adopted, and has a three-section structure composed of a first member 47, a second member 48 and a third member 49 from the side of the developer roller 11 .

As illustrated in FIG. 2(*b*), the first member 47 and the third member 49 are provided to a cuboid projection extending in a radial direction. The second member 48 is provided with recessed sections on the side of the first member 47 and the third member 49 respectively, with which the first member 47 and the third member 49 are in engagement. The recessed sections on both sides of the second member 48 are provided so as to extend in directions which cross at right angles. The projected section and the recessed section are provided so as to be slidable in the lengthwise direction in the state where the projected section is in engagement with the recessed section. As a result, deviation of the rotation center axis of the gear 52 and the rotation center axis of the developer roller can be absorbed. By adopting the foregoing coupling 43, the rotation driving force can be transmitted across the parallel two axes which are not on the same line, without varying the angular velocity.

The rotation center of the developer roller 1 is not fixed at a predetermined position, but is determined base on a balance between the pressure welding force exerted from the developer unit 2 to the developer roller 11 and small elastic deformation of the developer roller 11 .

For example, in the case of adopting of a simple structure which is composed of a driving side and a driven side in replace of the coupling 43 of the three-section structure, due to the spin finishing force of both members of the coupling, such force which exerts in the direction of moving the developer roller to the center of the coupling.

In contrast, such unwanted force would not be exerted when adopting the coupling 32 of the three-section structure, thereby ensuring smooth rotation movements of the developer roller 11 while ensuring stable balance.

The first member 47 is provided so as to be capable of sliding in the axial direction with respect to the developer roller 11, and is not slidable in the rotation direction. Furthermore, as illustrated in FIG. 2(*b*) and FIG. 6, the first member 47 has a projected section 47*a* in engagement with the recessed section 53 formed in the gear 52, and receives the rotation driving force as transmitted from the gear 52.

In the state where the coupling 43 is installed in the image forming apparatus main body, the coupling is depressed onto the gear 52 by the pressure welding spring 44. In the state where the developer unit 2 is detached from the image forming apparatus main body, the coupling 43 is pressed onto the cover 42 of the developer unit 2 by the compression spring 44 to be held by the developer unit 2 without detachment.

The external gear 38 of the rear-side drum flange section 32*a* has teeth in the number of 37, and the gear 52 has teeth in the number of 16. For the barrel-shaped drum 31 with an outer diameter of 30 mm, as the developer roller 11 has an outer diameter of 16 mm, the peripheral surface of the developer roller 11 rotates at speed 1.23 times faster than the peripheral surface of the barrel-shaped drum 31. For the generally adopted structure, the peripheral surface of the developer roller 11 rotates at speed from 1.1 times to 1.5 times factor than the peripheral surface of the barrel-shaped drum 31. Namely, by setting the rotation speed of the peripheral surface of the barrel-shaped drum 31 higher than the peripheral surface of the barrel-shaped drum 31, insufficient supply of the developing agent onto the surface of the barrel-shaped drum 31 can be avoided.

The developer unit 2 of the present embodiment adopts a non-magnetic one-component contact developing system. In this non-magnetic one-component contact developing system, typically, an elastic rubber material is adopted for the surface of the developer roller 11, and the developer roller 11 is depressed against the barrel-shaped drum 31, and the peripheral surface of the developer roller 11 rotates at higher speed than the peripheral surface of the barrel-shaped drum 31. In this case, the rubber-like developer roller 11 is depressed against the surface of the mirror-like the barrel-shaped drum 31, considerable driving torque-load is generated.

In the case where the photoreceptor drum 3 and the developer roller 11 receive driving forces from the rotation drive means, due to backlash of the driving systems, such phenomenon that the photoreceptor drum 3 instantly starts rotating earlier, which causes the problem of jerky rotation movement. As a result, the banding is liable to occur in the developed image.

In the case where the rotation driving force is transmitted to the developer roller 11 by the external gear 38 of the photoreceptor drum 3, the rotation loads of the developer unit including the developer roller 11 increases, and a force is exerted in the direction the gear 52 on the developer roller 11 side releases. However, the gear 52 on the side of the developer roller 11 is supported by the support axis 50 mounted to the main body frame 69 which supports the drive shaft 62 of the photoreceptor drum 3. As a result, the gear 52 can be prevented from being released, and describe transmission of the rotation drive force can be ensured.

As described, the image forming apparatus main body and the photoreceptor drum 3 are mounted by making the internal gear 36 in engagement with the gear 67, which serves as the external gear. Therefore, smooth rotation movements of the photoreceptor drum 3 can be ensured. Namely, the rotation driving force to rotate the photoreceptor drum 3 at constant angular velocity can be transmitted from the image forming apparatus main body.

Further, by transmitting the rotation driving force to the developer unit 2 by the output section composed of the external gear 38, smooth rotation movements of the developer unit 2 can be ensured. Namely, from the photoreceptor drum 3 to the developer roller 11, rotation driving force, which rotates at constant angular velocity can be transmitted. In the rear-side flange section 32*a*, formed are the internal gear 36 serving as an input section and the external gear 38 serving as the output section. Namely, the input section and the output section are positioned in the same cross-section which crosses at right angle with respect to the drum shaft 30 serving as the rotation axis of the photoreceptor drum 30.

As a result, the force to be generated by the input-output section 2 with respect to the rear-side drum flange section 32*a* is generated in the same cross section. As a result, smooth rotation movements of the photoreceptor drum can be ensured without generating the force picking the rear-side flange section 32*a*. Furthermore, smooth ration force can be applied also from the rear-side drum flange section 32*a* to the developer unit 2, which outputs the rotation drive force.

Here, spur gears are adopted for the external gear 39 of the photoreceptor drum 3 and the gear 52 on the side of the developer roller 11. However, the present invention is not limited to the foregoing structure, and, for example, helical gears, which ensure still smoother driving transmission may be adopted. Furthermore, the gear and the gear 61 of the motor axis 60*a* may be equally adopted.

Next, the connection between the gear 67 and the rear-side drum flange section 32*a* will be explained in more detail.

Figure 7:
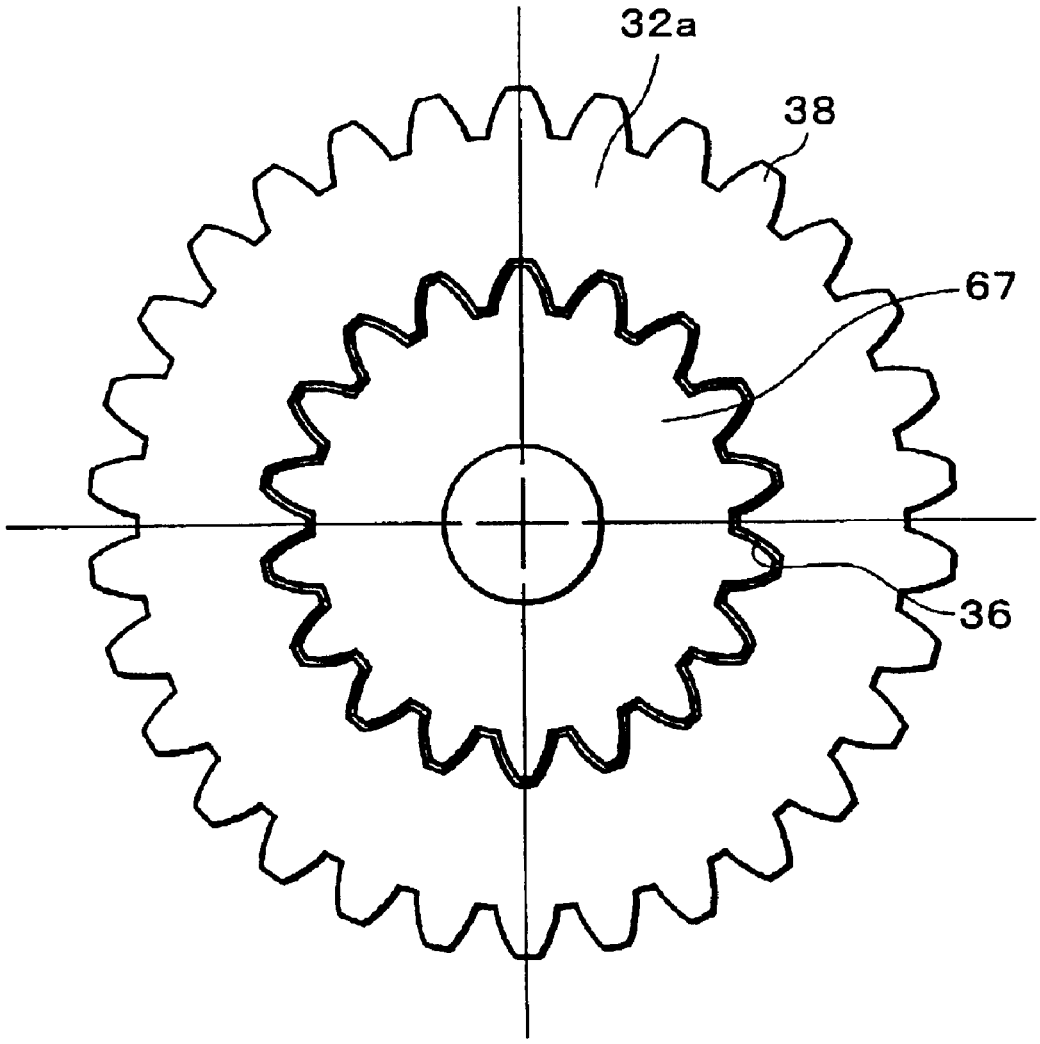
FIG. 7 is an explanatory view illustrating the state where an appropriate backlash is formed between a gear on the side of the image forming apparatus main body and an internal gear of the rear side drum flange section.

The cross-sectional view of the gear 67 and the rear-side drum flange section 32*a* with respect to the surface, which crosses the driving axis 62 and the drum shaft 30 at right angle is shown in FIG. 7.

As illustrated, the gear 67 is in engagement with the internal gear 36 formed in the rear-side flange section 32*a*. Here, the gear 67 and the internal gear 36 have the same number of teeth. Therefore, the gear 67 and the internal gear 36 are not provided for converting the number of rotations and for detachably connecting the driving shaft 62 and the rear-side drum flange section 32*a* and transmitting the rotation driving force from the drive shaft 62 to the rear-side drum flange section 32*a*.

The gear 67 and the internal gear 36 are provided to generate appropriate backlash. As a result, when mounting the photoreceptor drum 3, the gear 67 is inserted in the internal gear 36 with ease so as to be in engagement with the internal gear 36. Additionally, even if axis deviation or eccentricity occurs between the internal gear 67 and the internal gear 36, that can be absorbed by the backlash.

Figure 8:
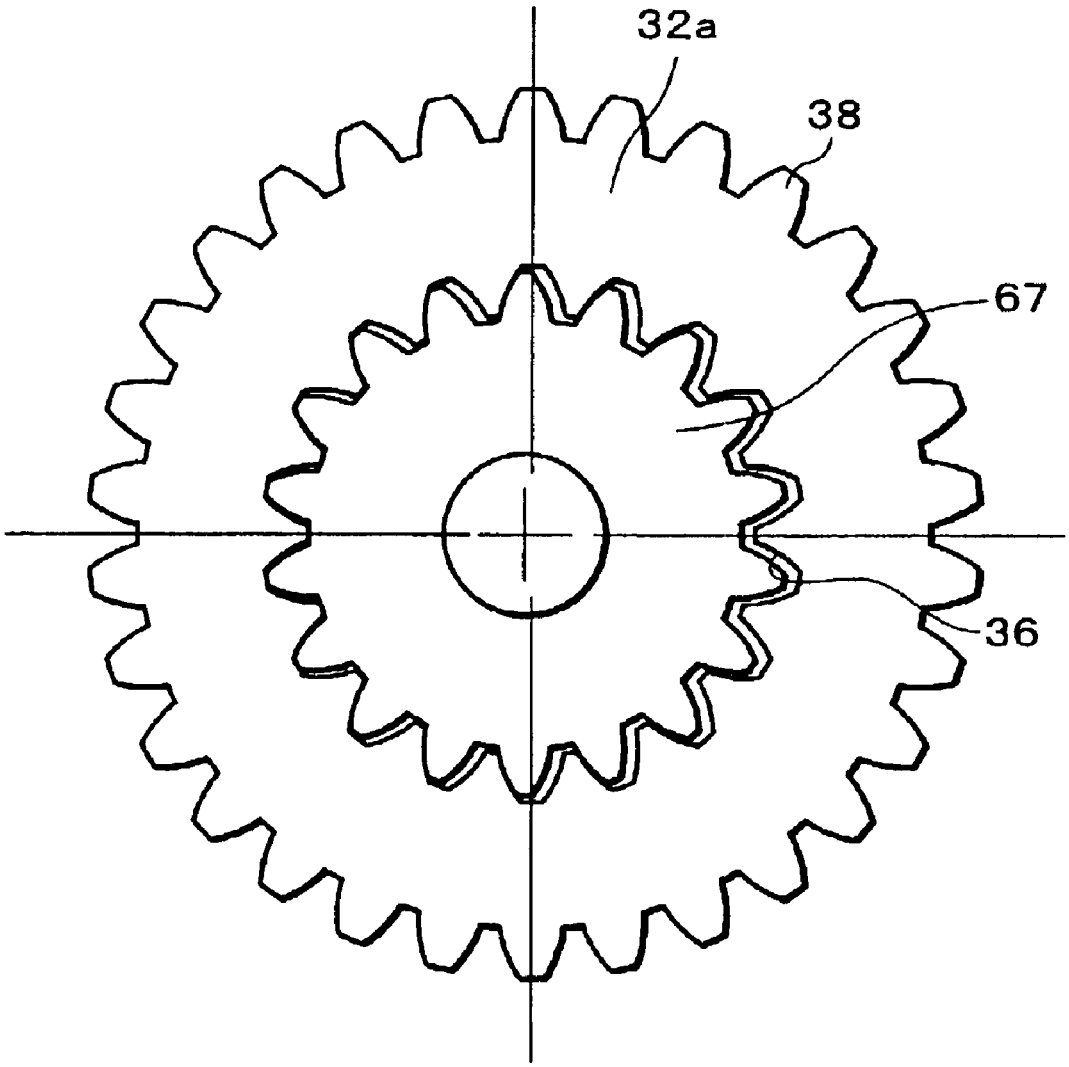
FIG. 8 is an explanatory view illustrating the state where an appropriate backlash is formed between a gear on the side of the image forming apparatus main body and an internal gear of the rear side drum flange section.

FIG. 8 shows the state where axis deviation or eccentricity occur between the gear 67 and the internal gear 36 without an appropriate backlash, and the gear 67 is cut into the internal gear 36.

As illustrated in FIG. 7, the image forming apparatus in accordance with the present embodiment is arranged so as to have an appropriate backlash between the gear 67 and the internal gear 36. As a result, the gear can be prevented from being damaged due to the gear to be in engagement therewith like the case of FIG. 8.

When transmitting driving force, jerky rotation movements typically occur in the case where backlash exits in the state where the driving load is exerted always in the positive direction, while the load is exerted in the negative direction.

However, in the structure of the present embodiment, the load between the process driving are summarized in the rear-side drum flange section 32*a*, and the load in the minus direction via the developer roller 11 and the load which rotates the photoreceptor drum 3 in ahead will not be generated. As described, the driving load is not exerted in the minus direction, even a backlash exists between the gear 67 and the internal gear 36, an occurrence of jerky rotation movements can be prevented.

As described, in the case where the rotation driving force is transmitted by the gear 67 and the internal gear 36, the following advantages can be obtained also for the force to be exerted to the rear-side drum flange section 32.

Figure 10:
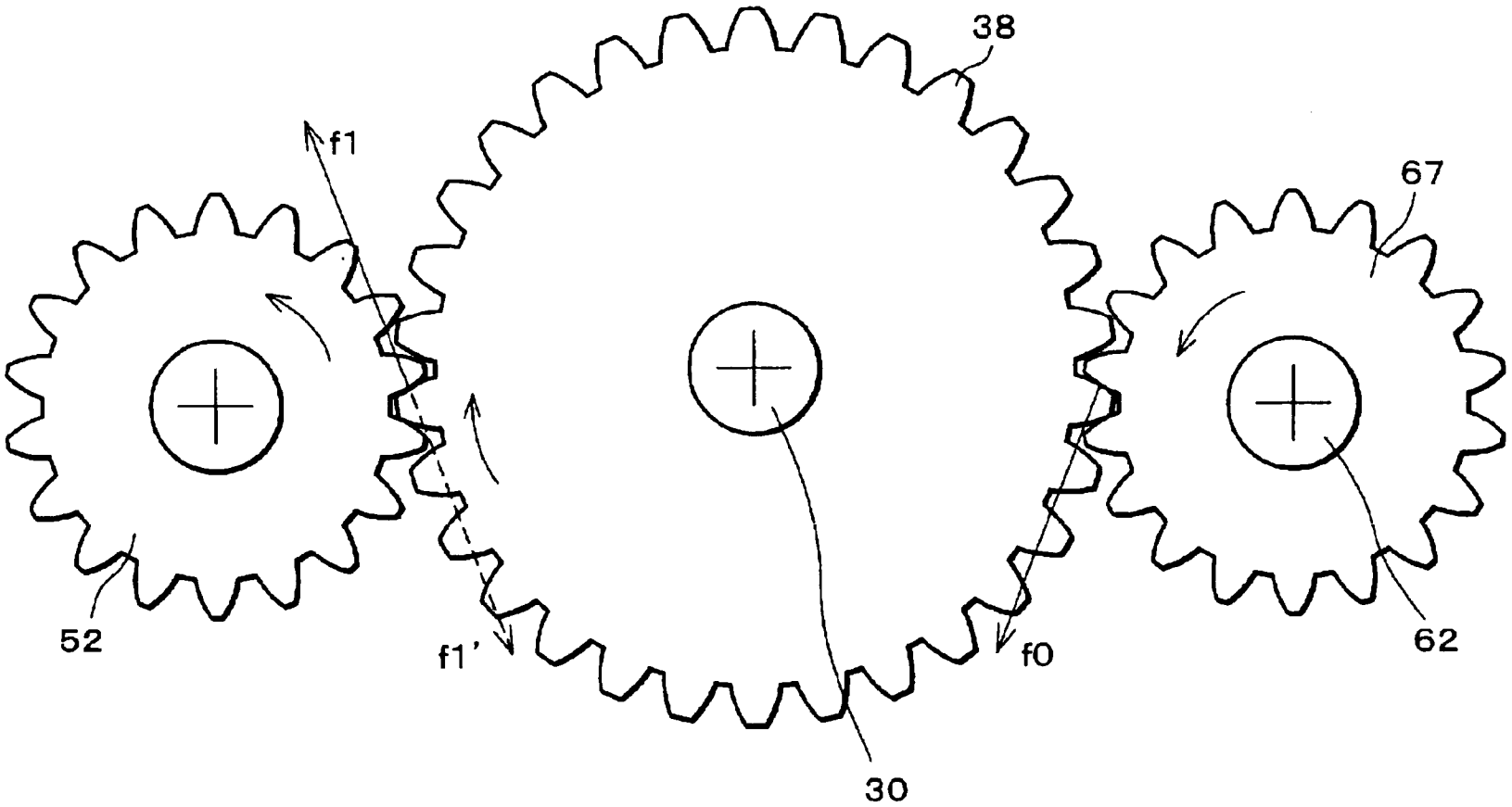
FIG. 10 is an explanatory view illustrating the state where the gear on the side of the image forming apparatus main body is in engagement with the external gear of the drum flange section on the rear side.

Assuming that the gear 67 is in engagement with the external gear 38 of the rear-side drum flange section 32*a*. Here, the outer gear 38 is also in engagement with the gear 52, and in the above case, as illustrated in FIG. 10, the gears 67 and 52 are in engagement with two positions of the external gear 38.

Here, the rear-side drum flange section 32*a* receives force f0 due to the rotation driving force from the gear 67, and receives the force of f1' as reaction force. As a result, the rear-side drum flange section 32*a* receives a large force in the downward direction in FIG. 1. As a result, buckling of the drum shaft 30 and the drive axis 62 occur, and the position of the photoreceptor drum 3 may change.

Figure 9:
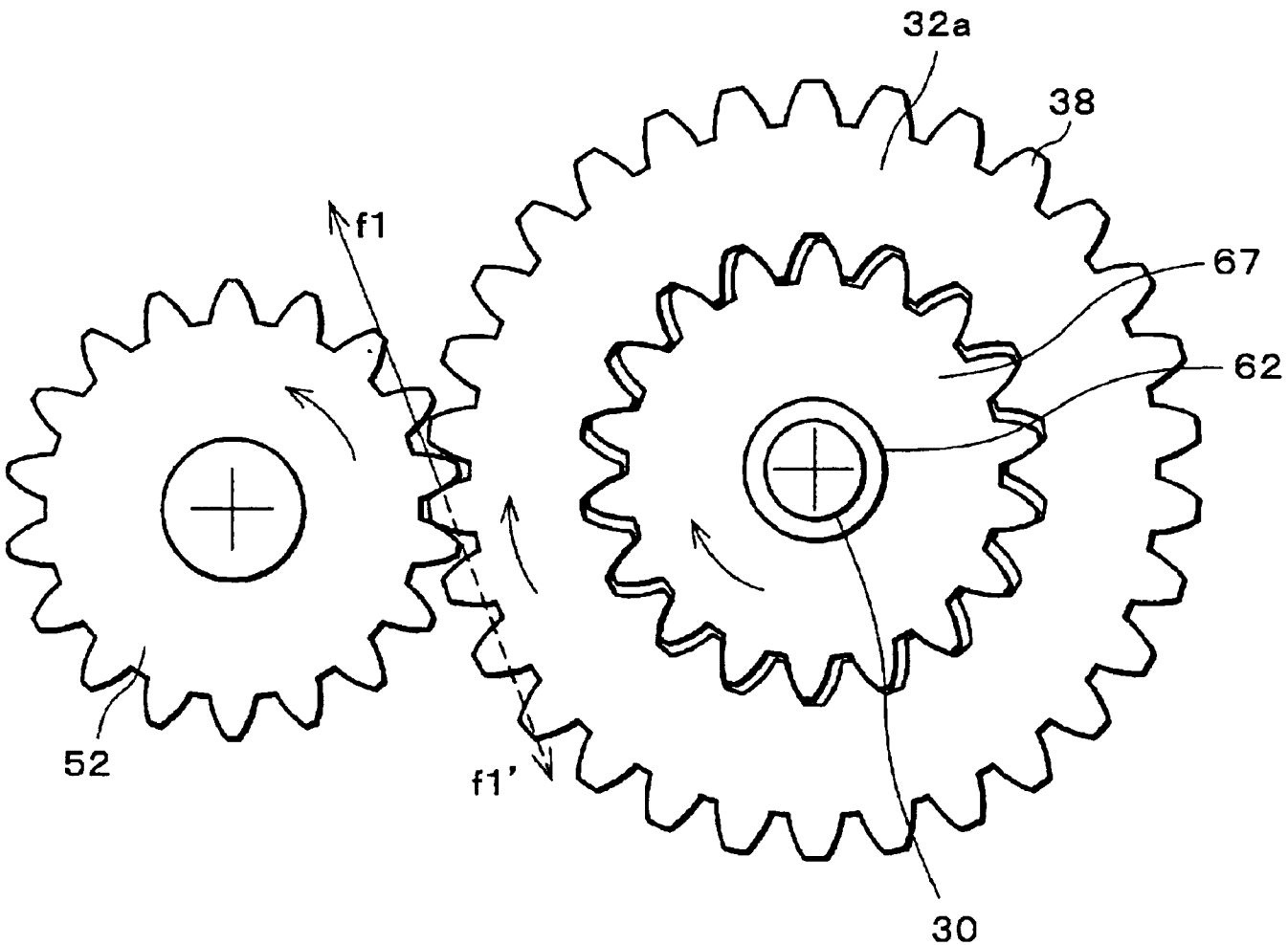
FIG. 9 is an explanatory view illustrating the state where the gear on the side of the image forming apparatus main body is in engagement with the internal gear of the flange section on the rear side.

In contrast, according to the structure of the present embodiment of FIG. 9, the force which the rear-side drum flange section 32*a* receives forces from the gear 67 is almost uniform in the rotation direction and are cancelled out. As a result, only the reaction force f1' from the force f1 with rotations of the gear 52 is exerted, and such force which is exerted in the direction of shifting the position of the foregoing photoreceptor drum 3 can be suppressed.

In the following, desirable structure for shapes of the gear 67 and the internal gear 36 will be explained.

In general, when making gears in engagement, if the numbers of teeth of the gears are too small, the following problem may occur. That is, the root part of the teeth is scratched (interfaced), and a part of the teeth cover is chipped off. However, in the case of adopting the above gear as a coupling, the interface is not liable to occur; however, the problem of undercutting may occur when preparing the gears with a small number of teeth by the cutting work. The foregoing undercutting is the problem in preparing high precision cutting work.

With the pressure angle of 20 °, the limit number of teeth for preventing the problem of undercutting is 17. In practice, however, the number of teeth can be reduced to 14 without the problem of undercutting. As described, by setting the number of teeth greater than 14, the teeth can be prevented from being scratched. Furthermore, it is preferable to set the number of teeth not more than 17. In the present embodiment, the number of teeth 67 is set to 18 to be safe.

It is also preferable that the gear be shaped to have an involute curve. As a result, even if axis deviation or eccentricity occurs between the gear 67 and the internal gear 36, the rotations of the driving shaft 62 can be surely transmitted, and as long as the driving shaft 62 rotates smoothly at constant angular velocity, the photoreceptor drum 3 can be rotated at constant angular velocity. Here, the gear of the involute curve with a module of 0.8 is formed.

Furthermore, in order to make the internal gear 36 in engagement with the gear 67 serving as the external gear, it is required to shift one of the gears. Here, the addendum modification coefficient of the internal gear 36 is set to +0.3, and the addendum modification coefficient of the gear 67 is set to +0.2, so that an appropriate backlash can be obtained. Here, when the difference in addendum modification coefficient is set to be larger than 0.15, the backlash would become too large, and it is therefore preferable to set the difference in addendum modification coefficient to not more than 0.15. Here, the difference in addendum modification coefficient is set to 0.1.

As described, the addendum modification coefficient of the internal gear 36 and the addendum modification coefficient of the gear 67 hold the following relationship:

$$0<X-Xs<0.15 \quad (1)$$

As a result, an appropriate backlash can be formed between the internal gear 36 and the gear 67, which serve as coupling. Therefore, even when the eccentric error of the gear 67 or axis deviation between the rotation axis 30 of the photoreceptor drum 3 and the drive shaft 62 as the rotation axis of the gear 67 occurs, the internal gear 36 can be in smooth engagement with the gear 67, and the rotation driving force can be transmitted smoothly at constant angular velocity.

In order to generate a backlash, it is possible to adopt the gear 67 arranged to have negative addendum modification. In this case, however, it is necessary to form the portion between the teeth of the gear 67 and the driving axis 62 thinner, or the driving axis 62 thinner, and thus a sufficient strength on the driving side may not be ensured. In response, by arranging so as to generate backlash by adopting the internal gear 36 which has a positive addendum modification, even if the gear 67 of the apparatus does not have a negative addendum modification, the photoreceptor drum 3 can be installed in the image forming apparatus main body with ease. As a result, it is not necessarily to make the gear 67 smaller than the standard size. As a result, a sufficient strength of the gear 67 of the image forming apparatus main body can be ensured.

As described, the photoreceptor drum of the present invention is arranged so as to include:

a barrel-shaped drum provided in an image forming apparatus main body, having a photosensitive layer formed on a peripheral surface thereof; and a flange having an input section provided at one end of the barrel-shaped drum, for receiving rotation driving force from the image forming apparatus main body, and an output section for transmitting the rotation driving force to the process unit which acts on the barrel-shaped drum, wherein the output section is composed of an external gear formed on a peripheral surface of the flange; and the input section is composed of an internal gear formed on an inner surface of the flange.

In the foregoing structure, it is preferable that the photoreceptor drum is detachably provided in the image forming apparatus main body.

It is also preferable that the internal gear is formed so as to have a positive addendum modification amount.

According to the foregoing structure, the input section which receives the rotation driving force from the image forming apparatus main body is composed of the internal gear formed on the inner surface of the flange, and thus for the apparatus output section for transmitting the rotation driving force to the input section in the image forming apparatus main body, for example, the external gear in engagement with the internal gear of the input section can be adopted. It is therefore possible to ensure smooth rotation forces of the photoreceptor drum. Namely, the rotation driving force can be transmitted from the image forming apparatus main body to the photoreceptor drum at constant angular velocity.

Further, by transmitting the rotation driving force to the process unit by the output section composed of the external gear, smooth rotation forces of the processing unit can be ensured. Namely, from the photoreceptor drum to the process unit, the rotation driving force can be transmitted at constant angular velocity.

It is preferable that the internal gear has teeth in a number of not less than 14.

By adopting the internal gear having teeth in a number of not less than 14, the undercutting of the teeth can be prevented in the process of cutting the teeth.

Another photoreceptor drum of the present invention is arranged so as to include:

a barrel-shaped drum detachably provided in an image forming apparatus main body, having a photosensitive layer formed on a peripheral surface thereof; and a flange having an input section provided at the barrel-shaped drum, for receiving rotation driving force from the image forming apparatus main body, and an output section for transmitting the rotation driving force to the process unit which acts on the barrel-shaped drum, wherein the output section is composed of an external gear formed on a peripheral surface of the flange; and the input section is composed of an internal gear formed on an inner surface of the flange, and the internal gear is formed so as to have a positive addendum modification amount.

According to the foregoing structure, by adopting the internal gear having a positive addendum modification amount, the engagement between the image forming apparatus main body (apparatus output section) and the photoreceptor drum can be achieved by adopting the external gear having teeth in the same number as that of the internal gear. Furthermore, a backlash can be formed between the external gear of the apparatus output section and the internal gear of the input section. Therefore, even if axis deviation or eccentricity occurs between the center of rotations of the internal gear and the center of rotations of the internal gear, that can be absorbed by the backlash. As a result, stable rotation movement of the photoreceptor drum can be achieved.

Furthermore, in the case of adopting the external gear for the apparatus output section, which has the same number of teeth as the internal gear of the input section, as the internal gear has a positive addendum modification amount, even if the external gear of the apparatus does not have a negative addendum modification, the photoreceptor drum can be installed in the image forming apparatus main body with ease. As a result, it is not necessarily to form the member which constitutes the apparatus output section of the image forming apparatus main body to be smaller than the standard size. As a result, a sufficient strength of the apparatus output section of the image forming apparatus main body can be ensured.

It is further preferable that the photoreceptor drum be arranged such that the internal gear is shaped to have an involute curve.

According to the foregoing structure, even if axis deviation or eccentricity occurs between the center of rotations of the internal gear and the center of rotations of the internal gear, rotations of the apparatus output section of the image forming apparatus main body can be surely transmitted to the photoreceptor drum with accuracy.

It is also preferable that the photoreceptor drum be arranged such that the output section and the input section are formed in the same cross-section orthogonal to a rotation axis of the photoreceptor drum.

According to the foregoing structure, forces in response to the input and output with respect to the flange are generated in the same cross section orthogonal to the rotation axis of the photoreceptor drum. As a result, smooth rotation movements of the photoreceptor drum can be ensured without generating the force picking the flange. Furthermore, the rotation driving force, which ensures the smooth rotation movement can be applied from the flange to the rotation member of the process unit.

Another photoreceptor drum of the present invention is arranged so as to include:

a barrel-shaped drum detachably provided in an image forming apparatus main body, having a photosensitive layer formed on a peripheral surface thereof; and a flange having an input section provided at one end of the barrel-shaped drum, for receiving rotation driving force from the image forming apparatus main body, and an output section for transmitting the rotation driving force to the process unit which acts on the barrel-shaped drum, wherein the output section is composed of an external gear formed on a peripheral surface of the flange; and the input section is composed of an internal gear formed on an inner surface of the flange, and the output section and the input section are formed in the same cross-section orthogonal to a rotation axis of the photoreceptor drum.

According to the foregoing structure, the input section which receives the rotation driving force from the image forming apparatus main body is composed of the internal gear formed on the inner surface of the flange, and thus for the apparatus output section for transmitting the rotation driving force to the input section in the image forming apparatus main body, for example, the external gear in engagement with the internal gear of the input section can be adopted. It is therefore possible to ensure smooth rotation movements of the photoreceptor drum. Further, by transmitting the rotation driving force to the processing unit by the output section composed of the external gear formed on the peripheral surface of the flange, smooth rotation movements of the processing unit can be ensured.

Furthermore, it is preferable that the photoreceptor drum be arranged such that the output section and the input section are formed in the same cross-section orthogonal to a rotation axis of the photoreceptor drum. Therefore, forces in response to the input and output with respect to the flange are generated in the same cross section orthogonal to the rotation axis of the photoreceptor drum. As a result, smooth rotation movements of the photoreceptor drum can be ensured without generating the force picking the flange. Furthermore, the rotation driving force which ensures the smooth rotation movements can be applied from the flange to the rotation member of the process unit.

According to the foregoing structure, the rotation driving forces transmitted to the photoreceptor drum from the apparatus output section of the image forming apparatus main body can be further transmitted to the process unit with accuracy. Namely, as long as the apparatus output section of the image forming at constant angular velocity, the photoreceptor drum can be rotated at constant angular velocity, thereby ensuring smooth rotation movements. Further, the smooth rotation movements of the process unit at constant angular velocity apparatus main body can be ensured.

The image forming apparatus of the present invention is arranged so as to include:

a photoreceptor drum and a process unit which acts on the photoreceptor drum which are detachably provided;

the photoreceptor drum including a barrel-shaped drum whose peripheral surface is coated with a photosensitive layer and which is provided with a flange;

a coupling section at which the photoreceptor drum is attached to or detached from the image forming apparatus includes an input section and an apparatus output section;

the input section is composed of an internal gear formed on the inner surface, and receives rotation driving force from the image forming apparatus main body; and the apparatus output section includes an external gear having teeth in the same number as the internal teeth, provided in an image forming apparatus main body for outputting rotation driving force from the image forming apparatus main body to the input section.

According to the foregoing structure, the input section composed of an internal gear in the flange of the photoreceptor drum and the apparatus output section composed of the external gear in the image forming apparatus main body function as the coupling between the photoreceptor drum and the image forming apparatus main body. Furthermore, the internal gear of the input section and the eternal gear of the apparatus output section have teeth in the same number. Therefore, a stable coupling can be achieved, and it is therefore possible to realize the image forming apparatus main body, which permits smooth rotation movements of the photoreceptor drum. Namely, it is possible to transmit the rotation driving force from the image forming apparatus main body to the photoreceptor drum to rotate the photoreceptor drum at constant angular velocity.

Here, it is preferable that the internal gear and the external gear have teeth which are shaped to have an involute curve.

With the foregoing structure, by adopting the same number of teeth for the external gear and the internal gear, it is possible to transmit the rotation driving force using all the teeth (whole circumference). Therefore, with respect to the driving axis which rotates the external gear of the apparatus output section, the external gear receives uniform force from the apparatus output section, and the tilt of the driving axis is less likely to occur, and rotation driving forces can therefore be transmitted with accuracy for a long period of time.

With the conventional coupling, it is not possible to measure the shape of the output section. Hear, the measuring method for gears is standardized by JGMA or JIS. Therefore, with such standardized method, it is possible to measure the shape of the external gear serving as an output section. As a result, it is possible to manage the shape precision of the output section with ease.

It is preferable that the image forming apparatus be arranged such that the flange includes an output section for transmitting rotation driving force to the process unit; and the output section and the input section are formed on the same cross-section orthogonal to the rotation axis of the photoreceptor drum.

According to the foregoing structure, forces in response to the input and output with respect to the flange are generated in the same cross section orthogonal to the rotation axis of the photoreceptor drum. As a result, smooth rotation movements of the photoreceptor drum can be ensured without generating the force picking the flange. Furthermore, the rotation driving force, which ensures the smooth rotation movements can be applied from the flange to the rotation member of the process unit. As a result, an image forming apparatus, which permits smooth rotation movements of the photoreceptor drum and the process unit can be achieved.

It is preferable that a backlash be provided between the internal gear of the input section and the external section of the apparatus output section.

According to the foregoing structure, the gear which functions as the coupling when installing the photoreceptor drum unit can be made in smooth engagement with the internal gear.

It is also preferable that the internal gear be formed so as to have a positive addendum modification amount.

According to the foregoing structure, the internal gear has a positive addendum modification amount, and thus even if the external gear of the apparatus does not have a negative addendum modification, the photoreceptor drum can be installed in the image forming apparatus main body with ease. As a result, it is not necessarily to form the member, which constitutes the apparatus output section of the image forming apparatus main body, to be smaller than the standard size. As a result, a sufficient strength of the apparatus output section of the image forming apparatus main body can be ensured.

It is preferable that the internal gear has teeth in a number of not less than 14.

By adopting the internal gear having teeth in a number of not less than 14, the undercutting of the teeth can be prevented in the process of cutting the teeth. As a result, a reliable image forming apparatus can be achieved.

It is preferable that the process unit is a developer unit having a developer roller, which is pressed onto the photoreceptor drum to supply developer to the photoreceptor drum.

According to the foregoing structure, even if the developer roller, which acts on the photoreceptor drum is pressed onto the photoreceptor drum, smooth rotation movements of the developer roller can be achieved with respect to the photoreceptor drum without generating forces which disturb the smooth rotation movements of the photoreceptor drum and the developer roller. As a result, an image without banding (uneven dark and light coloring of images occurred periodically) can be obtained.

It is also preferable to satisfy the condition of:

$$0<X-Xs\leqq 0.15,$$

wherein X is an addendum modification coefficient of the internal gear of the input section and Xs is an addendum modification of the external gear.

According to the foregoing structure, an appropriate backlash can be formed between the internal gear of the input section which functions as a coupling and the external gear of the apparatus output section. Therefore, even if eccentricity error of the external gear of the apparatus output section or the axis deviation between the rotation axis of the photoreceptor drum and the rotation axis of the external gear of the apparatus output section occur, the internal gear of the input section and the external gear of the apparatus output section can be made in smooth engagement, thereby smoothly transmitting rotation driving forces at constant angular velocity. Furthermore, the photoreceptor drum unit can be installed in the image forming apparatus main body with ease.

It is preferable that the internal gear and the external gear have teeth shaped to have an involute curve.

Another image forming apparatus of the present invention is arranged so as to include:

a photoreceptor drum unit provided with a photoreceptor drum including a barrel-shaped drum whose peripheral surface is coated with a photosensitive layer, the photoreceptor drum unit being detachably provided from an image forming apparatus main body, wherein:

the barrel-shaped drum includes a first flange at one end, a second flange at the other end and a rotation axis which passes through a center of the barrel-shaped drum and which supports the first flange and the second flange;

the first flange includes an input section for receiving rotation driving force from the image forming apparatus main body and an output section for transmitting rotation driving force to the process unit which acts on the photoreceptor drum;

one end of the rotation axis is projected out of the second flange and is supported by the flame member of the photoreceptor drum unit so as to be freely rotatable;

the other end of the rotation axis extends to a position where the input section and the output section are overlapped with each other; and at the position where the input section and the output section are overlapped, the other end of the rotation axis is fit in a fitting section provided in an axis of the image forming apparatus main body for transmitting rotation driving force to the barrel-shaped drum.

According to the foregoing structure, the fitting section which supports the rotation axis of the photoreceptor drum and the input section which inputs rotation driving force from the image forming apparatus to the photoreceptor drum, and the section which outputs the rotation driving force to the process unit which acts on the photoreceptor drum can be positioned on the same cross section orthogonal to the rotation axis of the photoreceptor drum. As a result, rotation driving force can be applied and output in and from the photoreceptor drum smoothly, and thus such force which causes axis deviation between the rotation axis and the driving axis of the photoreceptor drum can be eliminated.

Furthermore, the rotation axis of the photoreceptor drum is directly fit in the driving axis without via an intermediate member, axis deviation of rotation axis and the driving axis of the photoreceptor drum is not generated. As a result, the photoreceptor drum can be fit in the image forming apparatus main body with high precision.

It is preferable that in a state where the photoreceptor drum unit is mounted to an image forming apparatus main body, the flame member of the photoreceptor drum unit is supported by the support member which supports the axis of the image forming apparatus main body.

According to the foregoing structure, when mounting the photoreceptor drum unit to the image forming apparatus main body, the photoreceptor drum is supported by the axis of the image forming apparatus main body, and the flame of the photoreceptor drum unit is supported by the support member which supports the axis of the image forming apparatus main body. As a result, a contact between the photoreceptor drum and the flame of the photoreceptor drum unit can be completely avoided.

As a result, the photoreceptor drum can be prevented from being too tightly engaged both on the image forming apparatus main body side and the photoreceptor drum unit side, and thus smooth rotation movement of the photoreceptor drum can be ensured with high precision.

As described, the photoreceptor drum of the present invention is arranged such that:

the output section is composed of an external gear formed on a peripheral surface of the flange; and the input section is composed of an internal gear formed on an inner surface of the flange.

In the foregoing structure, it is preferable that the photoreceptor drum is detachably provided in the image forming apparatus main body.

It is also preferable that the internal gear is formed so as to have a positive addendum modification amount.

According to the foregoing structure, for the apparatus output section for transmitting the rotation driving force to the input section in the image forming apparatus main body, the external gear in engagement with the internal gear of the input section can be adopted. It is therefore possible to ensure smooth rotation movements of the photoreceptor drum and the process unit.

By adopting the internal gear having teeth in a number of not less than 14, the problem of undercutting of the teeth can be prevented in the process of cutting the teeth.

Another photoreceptor drum of the present invention is arranged such that:

the output section is composed of an external gear formed on a peripheral surface of the flange; and the input section is composed of an internal gear formed on an inner surface of the flange, and the internal gear is formed so as to have a positive addendum modification amount.

According to the foregoing structure, for example, for the apparatus output section, the external gear to be in engagement with the internal gear of the input section can be adopted. It is therefore possible to apply such driving force which ensures smooth rotation movements of the photoreceptor drum and the process unit. Furthermore, the engagement between the image forming apparatus main body (apparatus output section) and the photoreceptor drum can be realized by adopting the external gear having the same number of teeth as that of the internal gear. Furthermore, a backlash can be formed between the external gear of the apparatus output section and the internal gear of the input section. Therefore, even if axis deviation or eccentricity occurs between the center of rotations of the internal gear and the center of rotations of the internal gear, that can be absorbed by the backlash. As a result, stable rotation movement of the photoreceptor drum can be achieved.

Furthermore, as the internal gear has a positive addendum modification amount, even if the external gear of the apparatus does not have a negative addendum modification, the photoreceptor drum can be installed in the image forming apparatus main body with ease. As a result, it is not necessarily to form the member which constitutes the apparatus output section of the image forming apparatus main body to be smaller than the standard size. As a result, a sufficient strength of the apparatus output section of the image forming apparatus main body can be ensured.

It is further preferable that the photoreceptor drum be arranged such that the internal gear is shaped to have an involute curve.

According to the foregoing structure, even if axis deviation or eccentricity occurs between the center of rotations of the internal gear and the center of rotations of the internal gear, rotations of the apparatus output section of the image forming apparatus main body can be surely transmitted to the photoreceptor drum with accuracy.

It is also preferable that the photoreceptor drum be arranged such that the output section and the input section are formed in the same cross-section orthogonal to a rotation axis of the photoreceptor drum.

According to the foregoing structure, forces in response to the input and output with respect to the flange are generated in the same cross section orthogonal to the rotation axis of the photoreceptor drum. As a result, smooth rotation movements of the photoreceptor drum can be ensured without generating the force picking the flange. Furthermore, the rotation driving force, which ensures the smooth rotation movements can be applied from the flange to the rotation member of the process unit.

Another photoreceptor drum of the present invention is arranged so as to include:

the output section is composed of an external gear formed on a peripheral surface of the flange; and the input section is composed of an internal gear formed on an inner surface of the flange, and the output section and the input section are formed in the same cross-section orthogonal to a rotation axis of the photoreceptor drum.

According to the foregoing structure, the rotation driving forces transmitted to the photoreceptor drum from the apparatus output section of the image forming apparatus main body can be further transmitted to the process unit with accuracy. Namely, as long as the apparatus output section of the image forming at constant angular velocity, the photoreceptor drum can be rotated at constant angular velocity, thereby ensuring smooth rotation movements. Further, the smooth rotation movements of the process unit at constant angular velocity apparatus main body without generating jerky movement can be ensured.

The image forming apparatus of the present invention is arranged so as to include:

a photoreceptor drum and a process unit which acts on the photoreceptor drum which are detachably provided;

the photoreceptor drum including a barrel-shaped drum whose peripheral surface is coated with a photosensitive layer and which is provided with a flange;

a coupling section at which the photoreceptor drum is attached to or detached from the image forming apparatus includes an input section and an apparatus output section;

the input section is composed of an internal gear formed on the inner surface, and receives rotation driving force from the image forming apparatus main body; and the apparatus output section includes an external gear having teeth in the same number as the internal teeth, provided in an image forming apparatus main body for outputting rotation driving force from the image forming apparatus main body to the input section.

According to the foregoing structure, the input section composed of an internal gear in the flange of the photoreceptor drum and the apparatus output section composed of the external gear in the image forming apparatus main body function as the coupling between the photoreceptor drum and the image forming apparatus main body. Furthermore, the internal gear of the input section and the eternal gear of the apparatus output section have teeth in the same number. Therefore, a stable coupling can be achieved, and it is therefore possible to realize the image forming apparatus main body, which permits smooth rotation movements of the photoreceptor drum. Namely, it is possible to transmit the rotation driving force from the image forming apparatus main body to the photoreceptor drum to rotate the photoreceptor drum at constant angular velocity. Here, it is preferable that the internal gear and the external gear have teeth which are shaped to have an involute curve.

With the foregoing structure, by adopting the same number of teeth for the external gear and the internal gear, it is possible to transmit the rotation driving force using all the teeth (whole circumference). Therefore, with respect to the driving axis which rotates the external gear of the apparatus output section, the external gear receives uniform force from the apparatus output section, and the tilt of the driving axis is less likely to occur, and rotation driving forces can therefore be transmitted with accuracy for a long period of time.

With the conventional coupling, it is not possible to measure the shape of the output section. Hear, the measuring method for gears is standardized by JGMA or JIS. Therefore, with such standardized method, it is possible to measure the shape of the external gear serving as an output section. As a result, it is possible to manage the shape precision of the output section with ease.

It is preferable that the image forming apparatus be arranged such that the flange includes an output section for transmitting rotation driving force to the process unit; and the output section and the input section are formed on the same cross-section orthogonal to the rotation axis of the photoreceptor drum.

According to the foregoing structure, forces in response to the input and output with respect to the flange are generated in the same cross section orthogonal to the rotation axis of the photoreceptor drum. As a result, smooth rotation movements of the photoreceptor drum can be ensured without generating the force picking the flange. Furthermore, the rotation driving force, which ensures the smooth rotation movements can be applied from the flange to the rotation member of the process unit. As a result, an image forming apparatus, which permits smooth rotation movements of the photoreceptor drum and the process unit can be achieved.

It is preferable that a backlash be provided between the internal gear of the input section and the external section of the apparatus output section.

According to the foregoing structure, the gear which functions as the coupling when installing the photoreceptor drum unit can be made in smooth engagement with the internal gear.

It is also preferable that the internal gear be formed so as to have a positive addendum modification amount.

According to the foregoing structure, the internal gear has a positive addendum modification amount, and thus even if the external gear of the apparatus does not have a negative addendum modification, the photoreceptor drum can be installed in the image forming apparatus main body with ease. As a result, it is not necessarily to form the member, which constitutes the apparatus output section of the image forming apparatus main body, to be smaller than the standard size. As a result, a sufficient strength of the apparatus output section of the image forming apparatus main body can be ensured.

It is preferable that the internal gear has teeth in a number of not less than 14.

By adopting the internal gear having teeth in a number of not less than 14, the problem of undercutting the teeth can be prevented in the process of cutting the teeth. As a result, a reliable image forming apparatus can be achieved.

It is preferable that the process unit is a developer unit having a developer roller, which is pressed onto the photoreceptor drum to supply developer to the photoreceptor drum.

According to the foregoing structure, even if the developer roller, which acts on the photoreceptor drum is pressed onto the photoreceptor drum, smooth rotation movements of the developer roller can be achieved with respect to the photoreceptor drum without generating forces which disturb the smooth rotation movements of the photoreceptor drum and the developer roller. As a result, an image without banding (uneven dark and light coloring of images occurred periodically) can be obtained.

It is also preferable to satisfy the condition of:

$$0<X-Xs\leqq 0.15,$$

wherein X is an addendum modification coefficient of the internal gear of the input section and Xs is an addendum modification of the external gear.

According to the foregoing structure, an appropriate backlash can be formed between the internal gear of the input section which functions as a coupling and the external gear of the apparatus output section. Therefore, even if eccentricity error of the external gear of the apparatus output section or the axis deviation between the rotation axis of the photoreceptor drum and the rotation axis of the external gear of the apparatus output section occurs, the internal gear of the input section and the external gear of the apparatus output section can be made in smooth engagement, thereby smoothly transmitting rotation driving forces at constant angular velocity. Furthermore, the photoreceptor drum unit can be installed in the image forming apparatus main body with ease.

It is preferable that the internal gear and the external gear have teeth shaped to have an involute curve.

Another image forming apparatus of the present invention is arranged so as to include:

a photoreceptor drum unit provided with a photoreceptor drum including a barrel-shaped drum whose peripheral surface is coated with a photosensitive layer, the photoreceptor drum unit being detachably provided from an image forming apparatus main body, wherein:

the barrel-shaped drum includes a first flange at one end, a second flange at the other end and a rotation axis which passes through a center of the barrel-shaped drum and which supports the first flange and the second flange;

the first flange includes an input section for receiving rotation driving force from the image forming apparatus main body and an output section for transmitting rotation driving force to the process unit which acts on the photoreceptor drum;

one end of the rotation axis is projected out of the second flange and is supported by the flame member of the photoreceptor drum unit so as to be freely rotatable;

the other end of the rotation axis extends to a position where the input section and the output section are overlapped with each other; and at the position where the input section and the output section are overlapped, the other end of the rotation axis is fit in a fitting section provided in an axis of the image forming apparatus main body for transmitting rotation driving force to the barrel-shaped drum.

According to the foregoing structure, the fitting section which supports the rotation axis of the photoreceptor drum and the input section which inputs rotation driving force from the image forming apparatus to the photoreceptor drum, and the section which outputs the rotation driving force to the process unit which acts on the photoreceptor drum can be positioned on the same cross section orthogonal to the rotation axis of the photoreceptor drum. As a result, rotation driving force can be applied and output in and from the photoreceptor drum smoothly, and thus such force which causes axis deviation between the rotation axis and the driving axis of the photoreceptor drum can be eliminated.

Furthermore, the rotation axis of the photoreceptor drum is directly fit in the driving axis without via an intermediate member, the deviation of the rotation axis and the driving axis of the photoreceptor drum is not generated. As a result, the photoreceptor drum can be fit in the image forming apparatus main body with high precision.

It is preferable that in a state where the photoreceptor drum unit is mounted to an image forming apparatus main body, the flame member of the photoreceptor drum unit is supported by the support member which supports the axis of the image forming apparatus main body.

According to the foregoing structure, when mounting the photoreceptor drum unit to the image forming apparatus main body, the photoreceptor drum is supported by the axis of the image forming apparatus main body, and the flame of the photoreceptor drum unit is supported by the support member which supports the axis of the image forming apparatus main body. As a result, a contact between the photoreceptor drum and the flame of the photoreceptor drum unit can be completely avoided. As a result, the photoreceptor drum can be prevented from being too tightly engaged both on the image forming apparatus main body side and the photoreceptor drum unit side, and thus smooth rotation movement of the photoreceptor drum can be ensured with high precision.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A photoreceptor drum, comprising:

a cylindrical drum provided in an image forming apparatus main body, having a photosensitive layer formed on a peripheral surface thereof; and a flange having an input section provided at said cylindrical drum, for receiving rotation driving force from said image forming apparatus main body, and an output section for transmitting the rotation driving force to a process unit which acts on said cylindrical drum;

wherein said output section is composed of an external gear formed on a peripheral surface of said flange; and said input section is composed of an internal gear formed on an inner surface of said flange.

2. The photoreceptor drum as set forth in claim 1, wherein:

said internal gear is formed so as to have a positive addendum modification amount.

3. The photoreceptor drum as set forth in claim 1, wherein:

said internal gear has teeth having an involute curve.

4. The photoreceptor drum as set forth in claim 1, wherein:

said output section and said input section are formed in the same cross-section orthogonal to a rotation axis of the photoreceptor drum.

5. The photoreceptor drum as set forth in claim 1, wherein:

said photoreceptor drum is detachably provided in said image forming apparatus main body.

6. The photoreceptor drum as set forth in claim 1, wherein:

said internal gear has teeth in a number of not less than 14.

7. The photoreceptor drum as set forth in claim 1, wherein a portion of said flange contacts an inner cylindrical surface of said cylindrical drum.

8.The photoreceptor drum as set forth in claim 1, wherein:

said external gear is also formed on a peripheral surface of said cylindrical drum.

9. An image forming apparatus, comprising:

a photoreceptor drum and a process unit which acts on said photoreceptor drum which are detachably provided;

said photoreceptor drum including a cylindrical drum whose peripheral surface is coated with a photosensitive layer and which is provided with a flange;

a coupling section at which said photoreceptor drum is attached to or detached from said image forming apparatus that includes an input section and an apparatus output section; and said input section is composed of an internal gear formed on the inner surface of the flange, and receives rotation driving force from said image forming apparatus main body; and said apparatus output section includes an external gear having teeth shaped in an involute curve, and is provided in an image forming apparatus main body for outputting rotation driving force from said image forming apparatus main body to said input section, wherein a backlash is provided between said internal gear of said input section and said external section of said apparatus output section.

10. An image forming apparatus, comprising:

a photoreceptor drum and a process unit which acts on said photoreceptor drum which are detachably provided;

said photoreceptor drum including a cylindrical drum whose peripheral surface is coated with a photosensitive layer and which is provided with a flange;

a coupling section at which said photoreceptor drum is attached to or detached from said image forming apparatus that includes an input section and an apparatus output section; and said input section is composed of an internal gear formed on the inner surface of the flange, and receives rotation driving force from said image forming apparatus main body; and said apparatus output section includes an external gear having teeth shaped in an involute curve, and is provided in an image forming apparatus main body for outputting rotation driving force from said image forming apparatus main body to said input section, wherein said internal gear is formed so as to have a positive addendum modification amount.

11. The image forming apparatus as set forth in claim 10, satisfying the condition of:

$$0<X-Xs\leqq 0.15,$$

wherein x is an addendum modification coefficient of said internal gear of said input section and Xs is an addendum modification of said external gear.

12. An image forming apparatus comprising:

a photoreceptor drum unit provided with a photoreceptor drum including a cylindrical drum whose peripheral surface is coated with a photosensitive layer, said photoreceptor drum unit being detachably provided from an image forming apparatus main body, wherein:

said cylindrical drum includes a first flange at one end, a second flange at the other end and a rotation axis which passes through a center of said cylindrical drum and which supports said first flange and said second flange;

said first flange includes an input section for receiving rotation driving force from said image forming apparatus main body and an output section for transmitting rotation driving force to said process unit which acts on said photoreceptor drum;

one end of said rotation axis is projected out of said second flange and is supported by the frame member of said photoreceptor drum unit so as to be freely rotatable;

the other end of said rotation axis extends to a position where said input section and said output section are overlapped with each other; and at said position where said input section and said output section are overlapped, the other end of said rotation axis is fit in a fitting section provided in an axis of said image forming apparatus main body for transmitting rotation driving force to said cylindrical drum.

13. The image forming apparatus as set forth in claim 12, wherein:

in a state where said photoreceptor drum unit is mounted to an image forming apparatus main body, a frame member of said photoreceptor drum unit is supported by said support member which supports the axis of said image forming apparatus main body.

14. A photoreceptor drum applicable to an image forming apparatus by mounting it to the image forming apparatus, comprising:

a cylindrical drum; and a flange mounted to said photoreceptor drum, which is provided with an internal gear formed on its inner surface and an external gear formed on its peripheral surface, wherein the internal gear of said flange functions as an input section for receiving rotation driving force from an image forming apparatus main body when the photoreceptor drum is mounted to the image forming apparatus; and the external gear of said flange functions as an output section for transmitting rotation driving force to other unit than the photoreceptor drum when the photoreceptor drum is mounted to the image forming apparatus.

15. The image forming apparatus as set forth in claim 14, wherein:

said external gear is also formed on a peripheral surface of said cylindrical drum.

16. An image forming apparatus comprising a photoreceptor drum detachable from an image forming apparatus main body, wherein:

said photoreceptor drum comprises:

a cylindrical drum; and a flange mounted to said photoreceptor drum, which is provided with an internal gear formed on its inner surface and a first external gear formed on its peripheral surface; and said image forming apparatus further includes a second external gear provided in an image forming apparatus main body, for transmitting rotation driving force from the image forming apparatus main body to the internal gear of said flange, said second external gear being in engagement with the internal gear of said flange when the photoreceptor drum is mounted to the image forming apparatus; and a unit other than said photoreceptor drum, to be driven by driving force received from said first external gear of said flange.

17. The image forming apparatus as set forth in claim 16, wherein:

the internal gear of said flange and the first external gear are formed in the same cross-section orthogonal to a rotation axis of said photoreceptor drum.

18. The image forming apparatus as set forth in claim 16, wherein:

a backlash is provided between said internal gear and said first external gear in engagement with said internal gear.

19. The image forming apparatus as set forth in claim 16, wherein:

said internal gear is formed so as to have a positive addendum modification amount.

20. The image forming apparatus as set forth in claim 19, satisfying the condition of:

$$0<X-Xs\leqq 0.15$$

wherein X is an addendum modification coefficient of said internal gear and Xs is an addendum modification of said first external gear.

21. The image forming apparatus as set forth in claim 16, wherein:

said internal gear and said first external gear have the same number of teeth.

22. The image forming apparatus as set forth in claim 21, wherein:

said internal gear has teeth in a number of not less than 14.

23. The image forming apparatus as set forth in claim 16, wherein:

said unit other than said photoreceptor drum is a developer unit having a developer roller which is pressed onto said photoreceptor drum to supply developer to said photoreceptor drum.

24. The image forming apparatus as set forth in claim 16, wherein:

said internal gear and said first external gear have teeth having an involute curve.

25. The image forming apparatus as set forth in claim 16, wherein:

a portion of said flange is in physical contact with an inside surface of said photoreceptor drum.

26. The image forming apparatus as set forth in claim 16, wherein:

said first external gear is also formed on a peripheral surface of said cylindrical drum.

* * * * *

UNITED STATES PATENT AND TRADEMARK OFFICE

CERTIFICATE OF CORRECTION

PATENT NO. : 6,907,212 B2
APPLICATION NO. : 10/144930
DATED : June 14, 2005
INVENTOR(S) : Yoshikazu Harada et al.

It is certified that error appears in the above-identified patent and that said Letters Patent is hereby corrected as shown below:

**On the Title Page, item (56) under the heading FOREIGN PATENT PUBLICATIONS, add the following reference:

Technique Book (13)/The Working of Gear," 10th edition, published by Taiga Publication on July 15, 1998, page 43**

Signed and Sealed this

Eighteenth Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 6,907,212 B2
APPLICATION NO. : 10/144930
DATED : June 14, 2005
INVENTOR(S) : Yoshikazu Harada et al.

It is certified that error appears in the above-identified patent and that said Letters Patent is hereby corrected as shown below:

**On the Title Page, item (56) under the heading FOREIGN PATENT PUBLICATIONS, add the following reference:

"Technique Book (13)/The Working of Gear," 10th edition, published by Taiga Publication on July 15, 1998, page 43**

This certificate supersedes the Certificate of Correction issued December 18, 2007.

Signed and Sealed this

Twenty Second Day of April, 2008

JON W. DUDAS
*Director of the United States Patent and Trademark Office*